US007515128B2

(12) United States Patent
Dowling

(10) Patent No.: US 7,515,128 B2
(45) Date of Patent: Apr. 7, 2009

(54) METHODS AND APPARATUS FOR PROVIDING LUMINANCE COMPENSATION

(75) Inventor: Kevin J. Dowling, Westford, MA (US)

(73) Assignee: Philips Solid-State Lighting Solutions, Inc., Burlington, MA (US)

( * ) Notice: Subject to any disclaimer, the term of this patent is extended or adjusted under 35 U.S.C. 154(b) by 398 days.

(21) Appl. No.: 11/312,030

(22) Filed: Dec. 20, 2005

(65) Prior Publication Data

US 2006/0098077 A1 May 11, 2006

Related U.S. Application Data

(63) Continuation-in-part of application No. 11/081,020, filed on Mar. 15, 2005.

(60) Provisional application No. 60/637,554, filed on Dec. 20, 2004, provisional application No. 60/553,111, filed on Mar. 15, 2004.

(51) Int. Cl.
*G09G 3/32* (2006.01)
*G09G 3/34* (2006.01)
*H05B 37/02* (2006.01)

(52) U.S. Cl. ..... 345/83; 345/82; 345/76; 315/291

(58) Field of Classification Search ..... 345/76, 345/77, 82, 83; 315/291, 324
See application file for complete search history.

(56) References Cited

U.S. PATENT DOCUMENTS 6,016,038 A 1/2000 Mueller et al.
6,150,774 A 11/2000 Mueller et al.
6,166,496 A 12/2000 Lys et al.
6,211,626 B1 4/2001 Lys et al.
6,292,901 B1 9/2001 Lys et al.
6,340,868 B1 1/2002 Lys et al.
6,459,919 B1 10/2002 Lys et al.
6,498,440 B2 * 12/2002 Stam et al. ..... 315/291
6,528,954 B1 3/2003 Lys et al.
6,548,967 B1 4/2003 Dowling et al.
6,577,080 B2 6/2003 Lys et al.
6,608,453 B2 8/2003 Morgan et al.
6,624,597 B2 9/2003 Dowling et al.
6,639,574 B2 * 10/2003 Scheibe ..... 345/83
6,717,376 B2 4/2004 Lys et al.
6,720,745 B2 4/2004 Mueller et al.
6,774,584 B2 8/2004 Lys et al.
6,777,891 B2 8/2004 Lys et al.
6,781,329 B2 8/2004 Morgan et al.

(Continued)

OTHER PUBLICATIONS

Nayatani, Yoshinobu; "*A Colorimetric Explanation of the Helmholtz-Kohlrausch Effect*"; Color Research Application, vol. 23, No. 6, Dec. 1998.

(Continued)

*Primary Examiner*—Kevin M Nguyen

(57) ABSTRACT

Methods and apparatus for generating two or more different colors or color temperatures of light over a significant range of different saturations or different color temperatures, in which luminance compensation is provided. In one example, generated light is compensated, at least in part, for the "Helmholtz-Kohlrausch" (HK) effect, which models the perception of different brightnesses for different colors or color temperatures, notwithstanding identical luminances. In another example, lighting apparatus including one or more LEDs to generate two or more different colors or color temperatures of light are configured to provide luminance compensation so as to mitigate, at least in part, the HK effect.

13 Claims, 8 Drawing Sheets

U.S. PATENT DOCUMENTS 6,788,011 B2 9/2004 Mueller et al.
6,801,003 B2 10/2004 Schanberger et al.
6,806,659 B1 10/2004 Mueller et al.
6,869,204 B2 3/2005 Piepgras et al.
6,870,323 B1 3/2005 Cok
6,883,929 B2 4/2005 Dowling
6,888,322 B2 5/2005 Dowling et al.
6,897,624 B2 5/2005 Ducharme et al.
6,936,978 B2 8/2005 Morgan et al.
6,950,115 B2 9/2005 Brown Elliott
6,965,205 B2 11/2005 Piepgras et al.
6,967,448 B2 11/2005 Morgan et al.
6,969,954 B2 11/2005 Lys
6,975,079 B2 12/2005 Lys et al.
7,027,015 B2 4/2006 Booth, Jr. et al.
7,049,769 B2 * 5/2006 Boulouednine et al. ..... 315/324
7,067,995 B2 6/2006 Gunter et al.
7,075,242 B2 7/2006 Miller et al.
2002/0038157 A1 3/2002 Dowling et al.
2002/0044066 A1 4/2002 Dowling et al.
2002/0048169 A1 4/2002 Dowling et al.
2002/0070688 A1 6/2002 Dowling et al.
2002/0074559 A1 6/2002 Dowling et al.
2002/0078221 A1 6/2002 Blackwell et al.
2002/0130627 A1 9/2002 Dowling et al.
2002/0145394 A1 10/2002 Morgan et al.
2002/0145869 A1 10/2002 Dowling
2002/0152045 A1 10/2002 Dowling et al.
2002/0158583 A1 10/2002 Lys et al.
2002/0176259 A1 11/2002 Ducharme
2003/0011538 A1 1/2003 Lys et al.
2003/0028260 A1 2/2003 Blackwell
2003/0057884 A1 3/2003 Dowling et al.
2003/0057887 A1 3/2003 Dowling et al.
2003/0076281 A1 4/2003 Morgan et al.
2003/0100837 A1 5/2003 Lys et al.
2003/0133292 A1 7/2003 Mueller et al.
2003/0222587 A1 12/2003 Dowling et al.
2004/0036006 A1 2/2004 Dowling
2004/0052076 A1 3/2004 Mueller et al.
2004/0090191 A1 5/2004 Mueller et al.
2004/0090787 A1 5/2004 Dowling et al.
2004/0105261 A1 6/2004 Ducharme et al.
2004/0113568 A1 6/2004 Dowling et al.
2004/0116039 A1 6/2004 Mueller et al.
2004/0130909 A1 7/2004 Mueller et al.
2004/0178751 A1 9/2004 Mueller et al.
2004/0212320 A1 10/2004 Dowling et al.
2004/0212321 A1 10/2004 Lys et al.
2004/0212993 A1 10/2004 Morgan et al.
2005/0099824 A1 5/2005 Dowling et al.
2005/0116667 A1 6/2005 Mueller et al.
2005/0128496 A1 * 6/2005 Bala ..... 358/1.9
2005/0151489 A1 7/2005 Lys et al.
2005/0213352 A1 9/2005 Lys et al.
2005/0213353 A1 9/2005 Lys
2005/0218838 A1 10/2005 Lys
2005/0218870 A1 10/2005 Lys
2005/0219872 A1 10/2005 Lys
2005/0231133 A1 10/2005 Lys
2005/0236029 A1 10/2005 Dowling
2005/0236998 A1 10/2005 Mueller
2005/0253533 A1 11/2005 Lys et al.
2005/0275626 A1 12/2005 Mueller
2005/0276053 A1 12/2005 Nortrup
2006/0002110 A1 1/2006 Dowling

OTHER PUBLICATIONS

Sayer, James R., et al.; "Effects of Retroreflective Marking Color on the Detection of Pedestrians by Normal and Color Deficient Drivers"; University of Michigan Transportation Research Institute.

* cited by examiner

METHODS AND APPARATUS FOR PROVIDING LUMINANCE COMPENSATION

CROSS-REFERENCES TO RELATED APPLICATIONS

The present application claims the benefit, under 35 U.S.C. §119(e), of U.S. Provisional Application Ser. No. 60/637,554, filed Dec. 20, 2004, entitled "Systems and Methods for Emulating Illuminated Surfaces."

The present application also claims the benefit, under 35 U.S.C. §120, as a continuation-in-part of U.S. Nonprovisional application Ser. No. 11/081,020, filed Mar. 15, 2005, entitled "Methods and Systems for Providing Lighting Systems," which in turn claims priority to U.S. Provisional Application Ser. No. 60/553,111, filed Mar. 15, 2004, entitled "Lighting Methods and Systems."

Each of the foregoing applications is hereby incorporated herein by reference.

FIELD OF THE INVENTION

The present disclosure relates generally to the generation of variable color or variable color temperature light, wherein compensation is provided for the natural phenomenon of perceived different brightness for different colors or color temperatures having the same luminance.

BACKGROUND

A well-known phenomenon of human vision is that humans have different sensitivities to different colors. The sensors or receptors in the human eye are not equally sensitive to all wavelengths of light, and different receptors are more sensitive than others during periods of low light levels versus periods of relatively higher light levels. These receptor behaviors commonly are referred to as "scotopic" response (low light conditions), and "photopic" response (high light conditions). In the relevant literature, the scotopic response of human vision as a function of wavelength $\lambda$ often is denoted as $V'(\lambda)$ whereas the photopic response often is denoted as $V(\lambda)$; both of these functions represent a normalized response of human vision to different wavelengths $\lambda$ of light over the visible spectrum (i.e., wavelengths from approximately 400 nanometers to 700 nanometers). For purposes of the present disclosure, human vision is discussed primarily in terms of lighting conditions that give rise to the photopic response, which is maximum for light having a wavelength of approximately 555 nanometers.

A visual stimulus corresponding to a perceivable color can be described in terms of the energy emission of a light source that gives rise to the visual stimulus. A "spectral power distribution" (SPD) of the energy emission from a light source often is expressed as a function of wavelength $\lambda$, and provides an indication of an amount of radiant power per small constant-width wavelength interval that is present in the energy emission throughout the visible spectrum. The SPD of energy emission from a light source may be measured via spectroradiometer, spectrophotometer or other suitable instrument. A given visual stimulus may be thought of generally in terms of its overall perceived strength and color, both of which relate to its SPD.

One measure of describing the perceived strength of a visual stimulus, based on the energy emitted from a light source that gives rise to the visual stimulus, is referred to as "luminous intensity," for which the unit of "candela" is defined. Specifically, the unit of candela is defined such that a monochromatic light source having a wavelength of 555 nanometers (to which the human eye is most sensitive) radiating 1/683 Watts of power in one steradian has a luminous intensity of 1 candela (a steradian is the cone of light spreading out from the source that would illuminate one square meter of the inner surface of a sphere of 1 meter radius around the source). The luminous intensity of a light source in candelas therefore represents a particular direction of light emission (i.e., a light source can be emitting with a luminous intensity of one candela in each of multiple directions, or one candela in merely one relatively narrow beam in a given direction).

From the definition above, it may be appreciated that the luminous intensity of a light source is independent of the distance at which the light emission ultimately is observed and, hence, the apparent size of the source to an observer. Accordingly, luminous intensity in candelas itself is not necessarily representative of the perceived strength of the visual stimulus. For example, if a source appears very small at a given distance (e.g., a tiny quartz halogen bulb), the perceived strength of energy emission from the source is relatively more intense as compared to a source that appears somewhat larger at the same distance (e.g., a candle), even if both sources have a luminous intensity of 1 candela in the direction of observation. In view of the foregoing, a measure of the perceived strength of a visual stimulus, that takes into consideration the apparent area of a source from which light is emitted in a given direction, is referred to as "luminance," having units of candelas per square meter ($cd/m^2$). The human eye can detect luminances from as little as one millionth of a $cd/m^2$ up to approximately one million $cd/m^2$ before damage to the eye may occur.

The luminance of a visual stimulus also takes into account the photopic (or scotopic) response of human vision. Recall from the definition of candela above that radiant power is given in terms of a reference wavelength of 555 nanometers. Accordingly, to account for the response of human vision to wavelengths other than 555 nanometers, the luminance of the stimulus (assuming photopic conditions) typically is determined by applying the photopic response $V(\lambda)$ to the spectral power distribution (SPD) of the light source giving rise to the stimulus. For example, the luminance L of a given visual stimulus under photopic conditions may be given by:

$$L=K(P_1V_1+P_2V_2+P_3V_3+\ldots), \quad (1)$$

where $P_1$, $P_2$, $P_3$, etc., are points on the SPD indicating the amount of power per small constant-width wavelength interval throughout the visible spectrum, $V_1$, $V_2$, and $V_3$, etc., are the values of the $V(\lambda)$ function at the central wavelength of each interval, and K is a constant. If K is set to a value of 683 and P is the radiance in watts per steradian per square meter, then L represents luminance in units of candelas per square meter ($cd/m^2$).

The "chromaticity" of a given visual stimulus refers generally to the perceived color of the stimulus. A "spectral" color is often considered as a perceived color that can be correlated with a specific wavelength of light. The perception of a visual stimulus having multiple wavelengths, however, generally is more complicated; for example, in human vision it is found that many different combinations of light wavelengths can produce the same perception of color.

Chromaticity is sometimes described in terms of two properties, namely, "hue" and "saturation." Hue generally refers to the overall category of perceivable color of the stimulus (e.g., purple, blue, green, yellow, orange, red), whereas saturation generally refers to the degree of white which is mixed with a perceivable color. For example, pink may be thought of as having the same hue as red, but being less saturated. Stated differently, a fully saturated hue is one with no mixture of white. Accordingly, a "spectral hue" (consisting of only one wavelength, e.g., spectral red or spectral blue) by definition is fully saturated. However, one can have a fully saturated hue without having a spectral hue (consider a fully saturated magenta, which is a combination of two spectral hues, i.e., red and blue).

A "color model" that describes a given visual stimulus may be defined in terms based on, or related to, luminance (perceived strength or brightness) and chromaticity (hue and saturation). Color models (sometimes referred to alternatively as color systems or color spaces) can be described in a variety of manners to provide a construct for categorizing visual stimuli; some examples of conventional color models employed in the relevant arts include the RGB (red, green, blue) model, the CMY (cyan, magenta, yellow) model, the HSI (hue, saturation, intensity) model, the YIQ (luminance, in-phase, quadrature) model, the Munsell system, the Natural Color System (NCS), the DIN system, the Coloroid System, the Optical Society of America (OSA) system, the Hunter Lab system, the Ostwald system, and various CIE coordinate systems in two and three dimensions (e.g., CIE x,y; CIE u',v'; CIELUV, CIELAB). For purposes of illustrating an exemplary color system, the CIE x,y coordinate system is discussed in detail below. It should be appreciated, however, that the concepts disclosed herein generally are applicable to any of a variety of color models, spaces, or systems.

One example of a commonly used model for expressing color is illustrated by the CIE chromaticity diagram shown in FIG. 1, and is based on the CIE color system. In one implementation, the CIE system characterizes a given visual stimulus by a luminance parameter Y and two chromaticity coordinates x and y that specify a particular point on the chromaticity diagram shown in FIG. 1. The CIE system parameters Y, x and y are based on the SPD of the stimulus, and also take into consideration various color sensitivity functions which correlate generally with the response of the human eye.

More specifically, colors perceived during photopic response essentially are a function of three variables, corresponding generally to the three different types of cone receptors in the human eye. Hence, the evaluation of color from SPD may employ three different spectral weighting functions, each generally corresponding to one of the three different types of cone receptors. These three functions are referred to commonly as "color matching functions," and in the CIE systems these color matching functions typically are denoted as $\bar{x}(\lambda)$, $\bar{y}(\lambda)$, $\bar{z}(\lambda)$. Each of the color matching functions $\bar{x}(\lambda)$, $\bar{y}(\lambda)$, $\bar{z}(\lambda)$ may be applied individually to the SPD of a visual stimulus in question, in a manner similar to that discussed above in Eq. (1) above (in which the respective components $V_1$, $V_2$, $V_3$ . . . of $V(\lambda)$ are substituted by corresponding components of a given color matching function), to generate three corresponding CIE "primaries" or "tristimulus values," commonly denoted as X, Y, and Z.

As mentioned above, the tristimulus value Y is taken to represent luminance in the CIE system and hence is commonly referred to as the luminance parameter (the color matching function $\bar{y}(\lambda)$ is intentionally defined to match the photopic response function $V(\lambda)$, such that the CIE tristimulus value Y=L, pursuant to Eq. (1) above). Although the value Y correlates with luminance, the CIE tristimulus values X and Z do not substantially correlate with any perceivable attributes of the stimulus. However, in the CIE system, important color attributes are related to the relative magnitudes of the tristimulus values, which are transformed into "chromaticity coordinates" x, y, and z based on normalization of the tristimulus values as follows:

$$x=X/(X+Y+Z)$$

$$y=Y/(X+Y+Z)$$

$$z=Z/(X+Y+Z)$$

Based on the normalization above, clearly x+y+z=1, so that only two of the chromaticity coordinates are actually required to specify the results of mapping an SPD to the CIE system.

In the CIE chromaticity diagram shown in FIG. 1, the chromaticity coordinate x is plotted along the horizontal axis, while the chromaticity coordinate y is plotted along the vertical axis. The chromaticity coordinates x and y depend only on hue and saturation, and are independent of the amount of luminous energy in the stimulus; stated differently, perceived colors with the same chromaticity, but different luminance, all map to the same point x,y on the CIE chromaticity diagram. The curved line 50 in the diagram of FIG. 1 serving as the upper perimeter of the enclosed area indicates all of the spectral colors (pure wavelengths) and is often referred to as the "spectral locus" (the wavelengths along the curve are indicated in nanometers). Again, the colors falling on the line 50 are by definition fully saturated colors. The straight line 52 at the bottom of the enclosed area in the diagram, connecting the blue (approximately 420 nanometers) and red (approximately 700 nanometers) ends, is referred to as the "purple boundary" or the "line of purples." This line represents colors that cannot be produced by any single wavelength of light; however, a point along the purple boundary nonetheless may be considered to represent a fully saturated color.

In FIG. 1, an "achromatic point" E is indicated at the coordinates x=y=1/3, representing full spectrum white. Hence, colors generally are deemed to become less saturated as one moves from the boundaries of the enclosed area toward the point E. FIG. 2 provides another illustration of the chromaticity diagram shown in FIG. 1, in which approximate color regions are indicated for general reference, including a region around the achromatic point E corresponding to generally perceived white light.

White light often is discussed in terms of "color temperature" rather than "color;" the term "color temperature" essentially refers to a particular subtle color content or shade (e.g., reddish, bluish) of white light. The color temperature of a given white light visual stimulus conventionally is characterized according to the temperature in degrees Kelvin (K) of a black body radiator that radiates essentially the same spectrum as the white light visual stimulus in question. Black body radiator color temperatures fall within a range of from approximately 700 degrees K (generally considered the first visible to the human eye) to over 10,000 degrees K; white light typically is perceived at color temperatures above 1500-2000 degrees K. Lower color temperatures generally indicate white light having a more significant red component or a "warmer feel," while higher color temperatures generally indicate white light having a more significant blue component or a "cooler feel."

FIG. 3 shows a lower portion of the chromaticity diagram of FIG. 2, onto which is mapped a "white light/black body curve" 54, illustrating representative CIE coordinates of a black body radiator and the corresponding color temperatures. As can be seen in FIG. 3, a significant portion of the white light/black body curve 54 (from about 2800 degrees K to well above 10,000 degrees K) falls within the region of the CIE diagram generally identified as corresponding to white light (the achromatic point E corresponds approximately to a color temperature of 5500 degrees K). As discussed above, color temperatures below about 2800 degrees K fall into regions of the CIE diagram that typically are associated with "warmer" white light (i.e., moving from yellow to orange to red).

One anomaly of human visual perception is that different colors or color temperatures (i.e., having different CIE chromaticity coordinates x and y) having a same luminance (i.e., a same CIE luminance parameter Y) actually may be perceived to have different brightnesses, even if perceived under the same photopic viewing conditions. This phenomenon is referred to in the relevant literature as the "Helmholtz-Kohlrausch" effect (hereinafter referred to as the HK effect). A variety of efforts have been made to model the HK effect (e.g., based on empirical data), and some exemplary discussions may be found in Nakano et al., "A Simple Formula to Calculate Brightness Equivalent Luminance," CIE No. 133, CIE 24$^{th}$ Session, Warsaw, V.1, Part 1, pages 33-37, 1999; Natayani et al., "Perceived Lightness of Chromatic Object Color Including Highly Saturated Colors," Color Res. Appl., 1, pages 127-141, 1992; Hunt, RWG, "Revised Colour-appearance model for related and unrelated colors," Color Research Appl., 16, pages 146-165, and Natayani, Y., "A Colorimetric Explanation of the Helmholtz-Kohlrausch Effect," Color Research Appl., Vol. 23, No. 6, 1998, each of which is incorporated herein by reference.

In general, according to the HK effect, saturated colors are perceived to be brighter than less saturated colors even when equal in luminance. Thus, if a white light and a saturated red light of the same luminance are compared side by side under the same viewing conditions, the red light looks brighter than the white to most observers. Similarly, if a white light and a saturated blue-green light of the same luminance are compared side by side, the blue-green light looks brighter than the white.

If, however, the saturated red and blue-green lights above are then added together and compared with the additive mixture of the two white lights above, the respective perceived brightnesses of the two mixtures are now similar; in this situation, the luminance of both mixtures is the same, and the perceived brightness of the mixtures also is the same. This arises because the mixture of the saturated red and blue-green light results in a whitish color, and the additional perceived brightness associated with the individual saturated colors has disappeared in the mixture. In view of the foregoing, while the luminance for different colors is additive, the perceived brightnesses of two different colors may not be additive.

An empirical formula has been developed (Kaiser, P. K., CIE Journal 5, 57 (1986)) that makes it possible to identify color stimuli which, on average, may be expected to be perceived as equally bright. First, a factor F is evaluated from the CIE chromaticity coordinates x and y corresponding to a given stimulus as follows:

$$F=0.256-0.184y-2.527xy+4.656x^3y+4.657xy^4. \quad (2)$$

Then, if two stimuli have respective luminances $Y_1$ and $Y_2$, and factors $F_1$ and $F_2$, the two stimuli are perceived with equal brightness if:

$$\log(Y_1)+F_1=\log(Y_2)+F_2. \quad (3)$$

If the left and right sides of Eq. (3) above are not equal, then whichever is greater indicates the stimulus having the greater perceived brightness. Similarly, it may be appreciated from Eq. (3) that, given equal luminance values $Y_1$ and $Y_2$ for two different stimuli, they will appear equally as bright to an observer if $F_1$ equals $F_2$.

FIG. 4 illustrates the CIE chromaticity diagram of FIG. 1, on which loci or "contours" 70A, 70B, 70C, etc., of equal values of F are shown based on Eq. (2) above. Again, two different colors falling into the same loci or contour appear equally as bright at the same luminance; hence, each contour indicated in FIG. 4 may be conceptually thought of as an "isobrightness" contour. The collection of isobrightness contours establishes the variation in perceived brightness across all chromaticity coordinates. The numbered values in FIG. 4 are given in terms of $10^F$ for each contour. It may be observed by comparing FIGS. 2 and 4 that the nadir 70 of the contours (minimum value of $10^F$=0.836) occurs in a generally yellowish region of the CIE chromaticity diagram. From FIG. 4, it also may be appreciated that, pursuant to the HK effect, $10^F$ generally tends to increase with increased saturation (i.e., as one moves from the yellowish region around the nadir 70 toward the spectral locus 50 or the purple boundary 52 of the diagram), especially in the direction of saturated reds, greens, and blues (refer again to FIG. 2).

Considering both sides of Eq. (3) as base-10 exponents, and re-writing Eq. (3) in terms of the values $10^F$, provides the relationships:

$$Y_1 10^{F_1} = Y_2 10^{F_2} \quad (4)$$

$$Y_2 = \frac{10^{F_1}}{10^{F_2}} Y_1.$$

The relationships in Eq. (4) illustrate that the numeric values assigned to the contours in FIG. 4 provide factors by which the luminance of a first stimulus having a chromaticity lying in one of the contours may be adjusted (increased or decreased) relative to the luminance of a second stimulus having a chromaticity lying in a different contour, so that both stimuli appear to have the same brightness when seen under the same viewing conditions.

Accordingly, the collection of isobrightness contours given by Eq. (2) and the corresponding relationships in Eq. (4) establish the variation in perceived brightness across all chromaticity coordinates. For example, consider a first stimulus having a luminance $Y_1$ and chromaticity coordinates that fall in the contour 70B corresponding to $10^F$=1, and a second stimulus having a luminance $Y_2$ and chromaticity coordinates that fall in the contour 70G corresponding to $10^F$=1.5. For these two stimuli to be perceived as having the same brightness, according to Eq. (4) the luminance $Y_2$ needs to be (1/1.5) or $0.667Y_1$.

SUMMARY

In view of the foregoing, Applicants have recognized and appreciated that lighting apparatus configured to generate multi-colored light, including apparatus based on LED sources, may be prone to the "Helmholtz-Kohlrausch" (HK) effect. More specifically, lighting apparatus configured to generate multi-color or multi-color temperature light may generate different colors or color temperatures of light that are actually perceived to have significantly different brightnesses, notwithstanding identical luminances for the different colors or color temperatures. Accordingly, various embodiments of the present disclosure are directed to methods and apparatus for providing luminance compensation to lighting apparatus so as to mitigate, at least in part, the HK effect.

For example, one embodiment of the present disclosure is directed to a method, comprising an act of generating at least two different colors or color temperatures of light, over a significant range of different saturations or different color temperatures, with an essentially constant perceived brightness.

Another embodiment is directed to an apparatus, comprising at least one LED configured to generate at least two different colors or color temperatures of light over a significant range of different saturations or different color temperatures, and at least one controller to control the at least one LED so as to generate the at least two different colors or color temperatures of the light with an essentially constant perceived brightness.

Another embodiment is directed to a method, comprising acts of: A) mapping a lighting command to a reference frame in relation to which at least one model for the Helmholtz-Kohlrausch effect is defined, the lighting command specifying at least a color or a color temperature of light to be generated; and B) applying a luminance compensation factor to the lighting command, based on the at least one model for the Helmholtz-Kohlrausch effect and the mapped lighting command, to provide an adjusted lighting command.

Another embodiment is directed to an apparatus, comprising at least one LED, and at least one controller to control the at least one LED based at least in part on a lighting command that specifies at least first color or a first color temperature of light to be generated by the at least one LED. The at least one controller is configured to map the lighting command to a reference frame in relation to which at least one model for the Helmholtz-Kohlrausch effect is defined. The at least one controller further is configured to apply a luminance compensation factor to the lighting command, based on the at least one model for the Helmholtz-Kohlrausch effect and the mapped lighting command, to provide an adjusted lighting command.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, electroluminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The terms "lighting unit" and "lighting fixture" are used interchangeably herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources.

The terms "processor" or "controller" are used herein interchangeably to describe various apparatus relating to the operation of one or more light sources. A processor or controller can be implemented in numerous ways, such as with dedicated hardware, using one or more microprocessors that are programmed using software (e.g., microcode) to perform the various functions discussed herein, or as a combination of dedicated hardware to perform some functions and programmed microprocessors and associated circuitry to perform other functions. Examples of processor or controller components that may be employed in various embodiments of the present invention include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present invention, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present invention include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The following patents and patent applications are hereby incorporated herein by reference:

U.S. Pat. No. 6,016,038, issued Jan. 18, 2000, entitled "Multicolored LED Lighting Method and Apparatus;"

U.S. Pat. No. 6,211,626, issued Apr. 3, 2001, entitled "Illumination Components;"

U.S. Pat. No. 6,608,453, issued Aug. 19, 2003, entitled "Methods and Apparatus for Controlling Devices in a Networked Lighting System;"

U.S. Pat. No. 6,548,967, issued Apr. 15, 2003, entitled "Universal Lighting Network Methods and Systems;"

U.S. patent application Ser. No. 09/886,958, filed Jun. 21, 2001, entitled Method and Apparatus for Controlling a Lighting System in Response to an Audio Input;"

U.S. patent application Ser. No. 10/078,221, filed Feb. 19, 2002, entitled "Systems and Methods for Programming Illumination Devices;"

U.S. patent application Ser. No. 09/344,699, filed Jun. 25, 1999, entitled "Method for Software Driven Generation of Multiple Simultaneous High Speed Pulse Width Modulated Signals;"

U.S. patent application Ser. No. 09/805,368, filed Mar. 13, 2001, entitled "Light-Emitting Diode Based Products;"

U.S. patent application Ser. No. 09/716,819, filed Nov. 20, 2000, entitled "Systems and Methods for Generating and Modulating Illumination Conditions;"

U.S. patent application Ser. No. 09/675,419, filed Sep. 29, 2000, entitled "Systems and Methods for Calibrating Light Output by Light-Emitting Diodes;"

U.S. patent application Ser. No. 09/870,418, filed May 30, 2001, entitled "A Method and Apparatus for Authoring and Playing Back Lighting Sequences;"

U.S. patent application Ser. No. 10/045,604, filed Mar. 27, 2003, entitled "Systems and Methods for Digital Entertainment;"

U.S. patent application Ser. No. 10/045,629, filed Oct. 25, 2001, entitled "Methods and Apparatus for Controlling Illumination;"

U.S. patent application Ser. No. 09/989,677, filed Nov. 20, 2001, entitled "Information Systems;"

U.S. patent application Ser. No. 10/158,579, filed May 30, 2002, entitled "Methods and Apparatus for Controlling Devices in a Networked Lighting System;"

U.S. patent application Ser. No. 10/163,085, filed Jun. 5, 2002, entitled "Systems and Methods for Controlling Programmable Lighting Systems;"

U.S. patent application Ser. No. 10/174,499, filed Jun. 17, 2002, entitled "Systems and Methods for Controlling Illumination Sources;"

U.S. patent application Ser. No. 10/245,788, filed Sep. 17, 2002, entitled "Methods and Apparatus for Generating and Modulating White Light Illumination Conditions;"

U.S. patent application Ser. No. 10/245,786, filed Sep. 17, 2002, entitled "Light Emitting Diode Based Products;"

U.S. patent application Ser. No. 10/325,635, filed Dec. 19, 2002, entitled "Controlled Lighting Methods and Apparatus;"

U.S. patent application Ser. No. 10/360,594, filed Feb. 6, 2003, entitled "Controlled Lighting Methods and Apparatus;"

U.S. patent application Ser. No. 10/435,687, filed May 9, 2003, entitled "Methods and Apparatus for Providing Power to Lighting Devices;"

U.S. patent application Ser. No. 10/828,933, filed Apr. 21, 2004, entitled "Tile Lighting Methods and Systems;"

U.S. patent application Ser. No. 10/839,765, filed May 5, 2004, entitled "Lighting Methods and Systems;"

U.S. patent application Ser. No. 11/010,840, filed Dec. 13, 2004, entitled "Thermal Management Methods and Apparatus for Lighting Devices;"

U.S. patent application Ser. No. 11/079,904, filed Mar. 14, 2005, entitled "LED Power Control Methods and Apparatus;"

U.S. patent application Ser. No. 11/081,020, filed on Mar. 15, 2005, entitled "Methods and Systems for Providing Lighting Systems;"

U.S. patent application Ser. No. 11/178,214, filed Jul. 8, 2005, entitled "LED Package Methods and Systems;"

U.S. patent application Ser. No. 11/225,377, filed Sep. 12, 2005, entitled "Power Control Methods and Apparatus for Variable Loads;" and U.S. patent application Ser. No. 11/224,683, filed Sep. 12, 2005, entitled "Lighting Zone Control Methods and Systems."

It should be appreciated that all combinations of the foregoing concepts and additional concepts discussed in greater detail below are contemplated as being part of the inventive subject matter disclosed herein. In particular, all combinations of claimed subject matter appearing at the end of this disclosure are contemplated as being part of the inventive subject matter disclosed herein.

DETAILED DESCRIPTION

Figure 1:
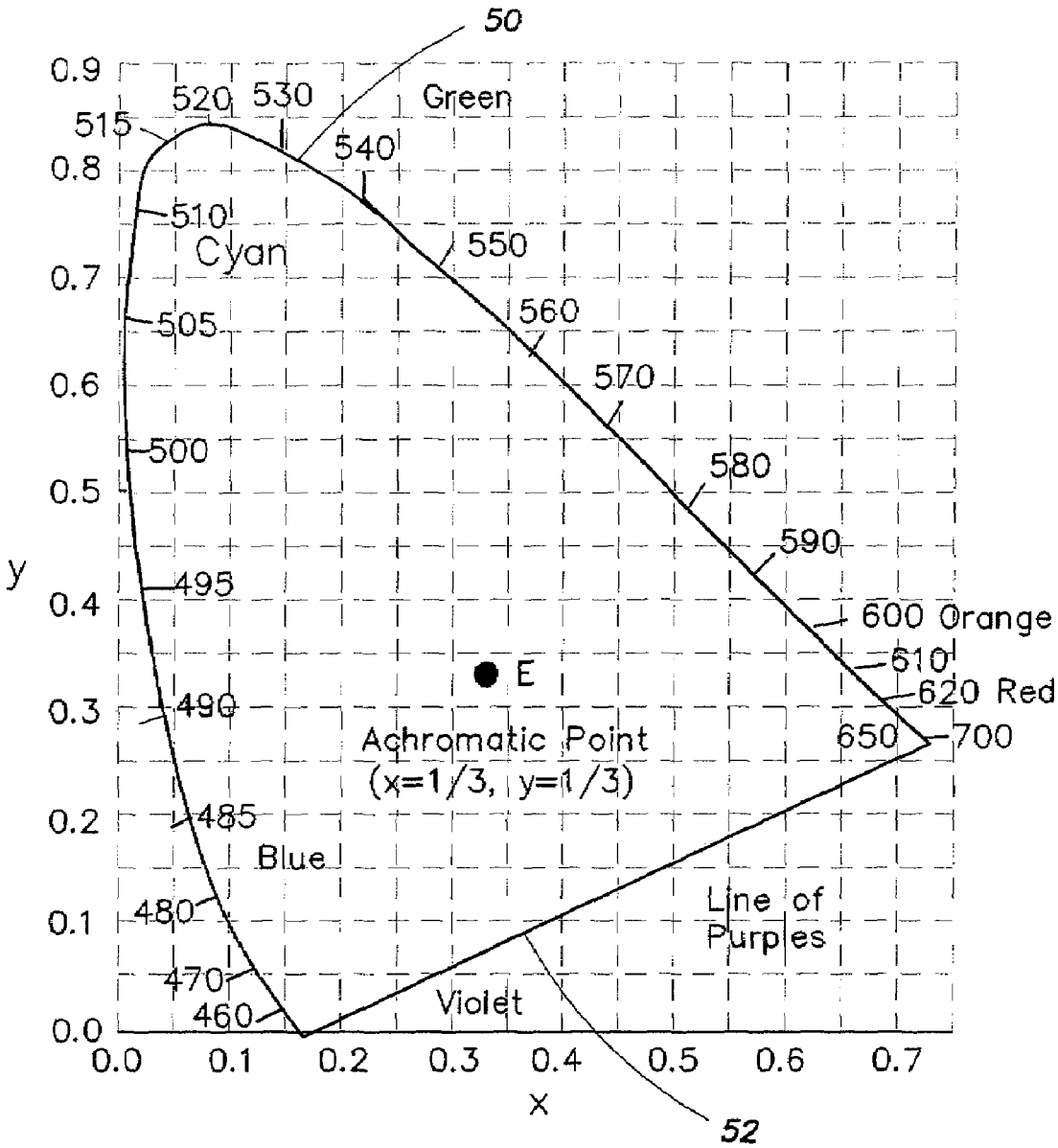
FIG. 1 PRIOR ART
FIG. 1 illustrates the conventional CIE Chromaticity Diagram.
Figure 2:
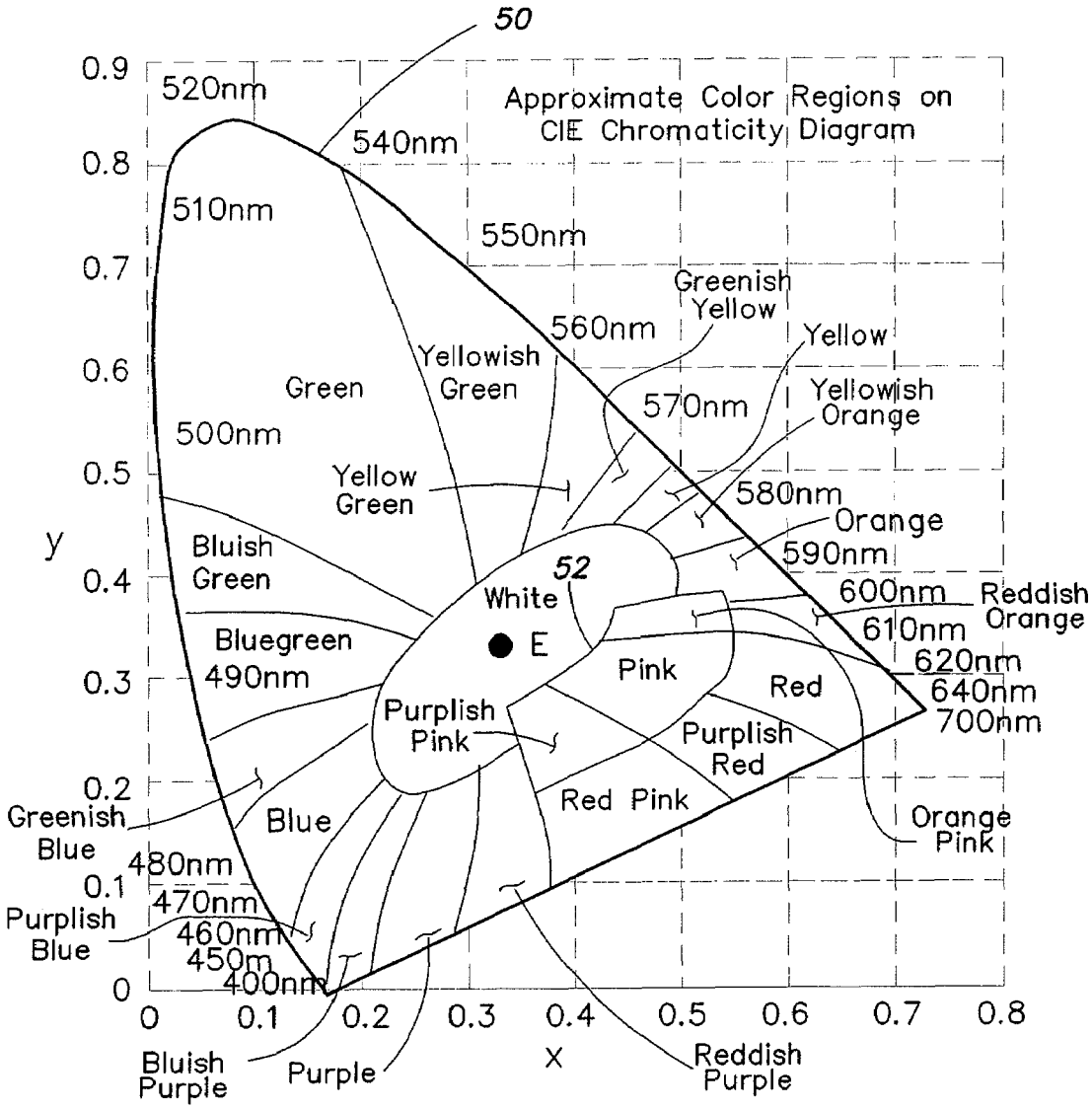
FIG. 2 PRIOR ART
FIG. 2 illustrates the diagram of FIG. 1, with approximate color categorizations indicated thereon.
Figure 3:
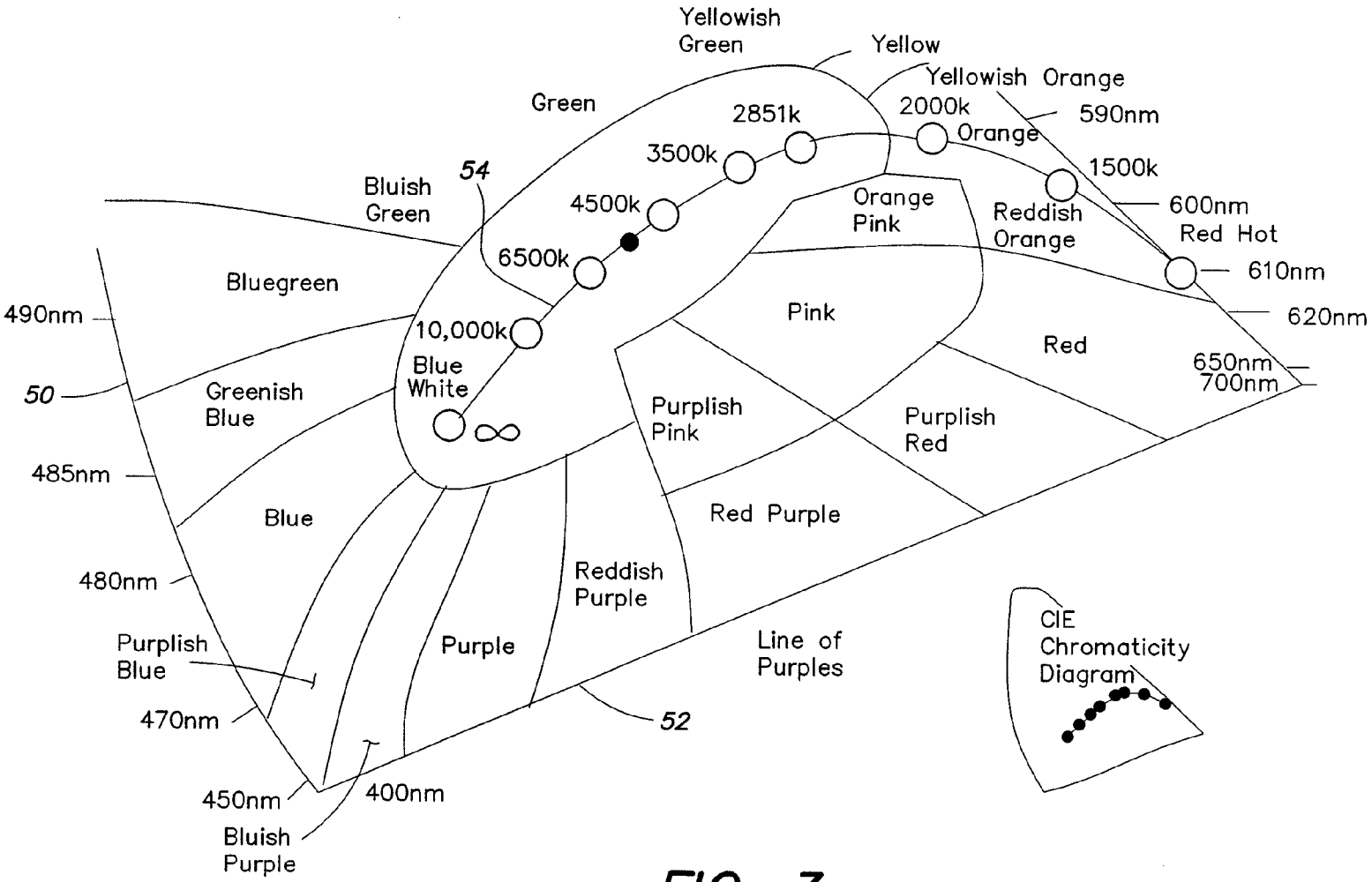
FIG. 3 PRIOR ART
FIG. 3 illustrates a portion of the diagram of FIG. 2, onto which is mapped a white light/black body curve representing color temperatures of white light.

Various embodiments of the present disclosure are described below, including certain embodiments relating particularly to LED-based light sources. It should be appreciated, however, that the present disclosure is not limited to any particular manner of implementation, and the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

Applicants have recognized and appreciated that lighting apparatus configured to generate multi-colored light, including apparatus based on LED sources, may be prone to the "Helmholtz-Kohlrausch" (HK) effect and hence generate different colors (or color temperatures) of light that may be perceived to have significantly different brightnesses, notwithstanding identical luminances for the different colors. Accordingly, various embodiments of the present disclosure are directed to methods and apparatus for providing luminance compensation to lighting apparatus so as to mitigate, at least in part, the HK effect.

To create multi-colored or white light based on additive color mixing principles, often multiple different color light sources are employed, for example red light, blue light and green light, to represent the primary colors. These three primary colors roughly represent the respective spectral sensitivities typical of the three different types of cone receptors in the human eye (having peak sensitivities at approximately 650 nanometers for red, 530 nanometers for green, and 425 nanometers for blue) under photopic conditions. Much research has shown that additive mixtures of primary colors in different proportions can create a wide range of colors discernible to humans. This is the well-known principle on which many color displays are based, in which a red light emitter, a blue light emitter, and a green light emitter are energized in different proportions to create a wide variety of perceivably different colors, as well as white light, based on additive mixing of the primary colors.

Solid-state lighting devices (e.g., light emitting diodes, or LEDs) are employed in many lighting applications. In one exemplary implementation, to create multi-colored or white light, multiple different color LEDs may be employed to represent the primary colors (e.g., red LEDs, blue LEDs and green LEDs). Although not completely monochromatic, the radiation generated by many "colored" LEDs (i.e., non-white LEDs) characteristically has a very narrow bandwidth spectrum (e.g., a full-width at half maximum, or FWHM, on the order of approximately 5-10 nanometers). Exemplary approximate dominant wavelengths for commonly available red, green and blue LEDs include 615-635 nanometers for red LEDs, 515-535 nanometers for green LEDs, and 460-475 nanometers for blue LEDs. Exemplary variable-color and white light generating devices based on LED light sources are discussed below in connection with FIGS. 5 and 6. It should be appreciated that while some exemplary devices are discussed herein in terms of red, green and blue LED sources, the present disclosure is not limited in this respect; namely, light generating devices according to various embodiments of the present disclosure may include LEDs having any of a variety of dominant wavelengths and overall spectrums (e.g., red LEDs, green LEDs, blue LEDs, cyan LEDs, yellow LEDs, amber LEDs, orange LEDs, broader spectrum white LEDs having various color temperatures, etc.)

Figure 5:
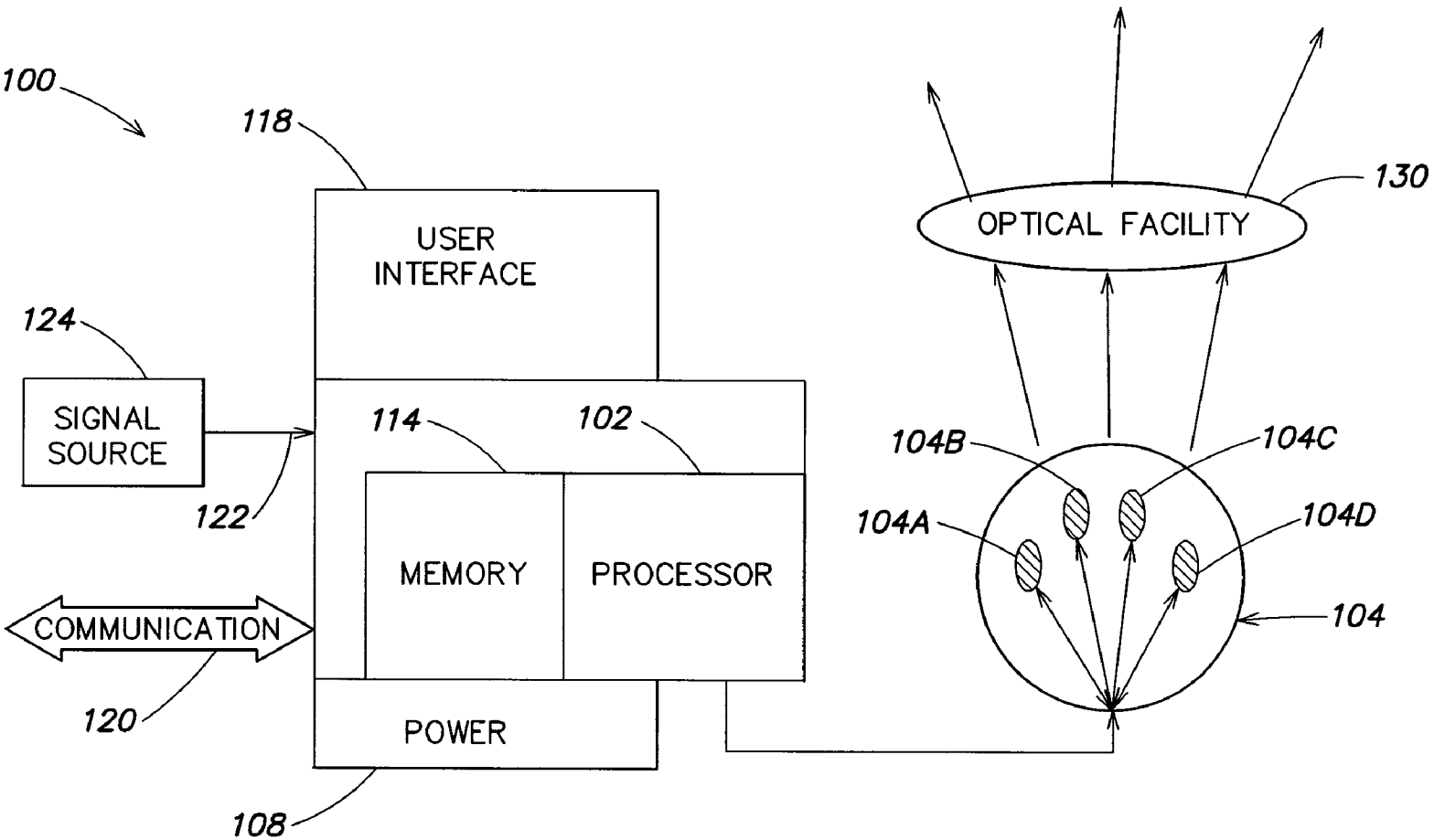
FIG. 5 is a diagram illustrating a lighting unit according to one embodiment of the disclosure.

FIG. 5 illustrates one example of a lighting unit 100 that may be configured according to one embodiment of the present disclosure to provide luminance-compensated variable color or variable color temperature light. Some examples of LED-based lighting units similar to those that are described below in connection with FIG. 5 may be found, for example, in U.S. Pat. No. 6,016,038, issued Jan. 18, 2000 to Mueller et al., entitled "Multicolored LED Lighting Method and Apparatus," and U.S. Pat. No. 6,211,626, issued Apr. 3, 2001 to Lys et al, entitled "Illumination Components," which patents are both hereby incorporated herein by reference.

In various embodiments of the present disclosure, the lighting unit 100 shown in FIG. 5 may be used alone or together with other similar lighting units in a system of lighting units (e.g., as discussed further below in connection with FIG. 6). Used alone or in combination with other lighting units, the lighting unit 100 may be employed in a variety of applications including, but not limited to, interior or exterior space (e.g., architectural) illumination in general, direct or indirect illumination of objects or spaces, theatrical or other entertainment-based/special effects lighting, decorative lighting, safety-oriented lighting, vehicular lighting, illumination of displays and/or merchandise (e.g. for advertising and/or in retail/consumer environments), combined illumination and communication systems, etc., as well as for various indication, display and informational purposes.

Additionally, one or more lighting units similar to that described in connection with FIG. 5 may be implemented in a variety of products including, but not limited to, various forms of light modules or bulbs having various shapes and electrical/mechanical coupling arrangements (including replacement or "retrofit" modules or bulbs adapted for use in conventional sockets or fixtures), as well as a variety of consumer and/or household products (e.g., night lights, toys, games or game components, entertainment components or systems, utensils, appliances, kitchen aids, cleaning products, etc.) and architectural components (e.g., lighted panels for walls, floors, ceilings, lighted trim and ornamentation components, etc.).

In one embodiment, the lighting unit 100 shown in FIG. 5 may include one or more light sources 104A, 104B, and 104C (shown collectively as 104), wherein one or more of the light sources may be an LED-based light source that includes one or more light emitting diodes (LEDs). In one aspect of this embodiment, any two or more of the light sources 104A, 104B, and 104C may be adapted to generate radiation of different colors (e.g. red, green, and blue, respectively). Although FIG. 5 shows three light sources 104A, 104B, and 104C, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

As shown in FIG. 5, the lighting unit 100 also may include a processor 102 that is configured to output one or more control signals to drive the light sources 104A, 104B, and 104C so as to generate various intensities of light from the light sources. For example, in one implementation, the processor 102 may be configured to output at least one control signal for each light source so as to independently control the intensity of light (e.g., radiant power in lumens) generated by each light source. Some examples of control signals that may be generated by the processor to control the light sources include, but are not limited to, pulse modulated signals, pulse width modulated signals (PWM), pulse amplitude modulated signals (PAM), pulse code modulated signals (PCM) analog control signals (e.g., current control signals, voltage control signals), combinations and/or modulations of the foregoing signals, or other control signals. In one aspect, one or more modulation techniques provide for variable control using a fixed current level applied to one or more LEDs, so as to mitigate potential undesirable or unpredictable variations in LED output that may arise if a variable LED drive current were employed. In another aspect, the processor 102 may control other dedicated circuitry (not shown in FIG. 5) which in turn controls the light sources so as to vary their respective intensities.

In one embodiment of the lighting unit 100, one or more of the light sources 104A, 104B, and 104C shown in FIG. 5 may include a group of multiple LEDs or other types of light sources (e.g., various parallel and/or serial connections of LEDs or other types of light sources) that are controlled together by the processor 102. Additionally, it should be appreciated that one or more of the light sources 104A, 104B, and 104C may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit 100.

In another aspect of the lighting unit 100 shown in FIG. 5, the lighting unit 100 may be constructed and arranged to produce a wide range of variable color radiation. For example, the lighting unit 100 may be particularly arranged such that the processor-controlled variable intensity (i.e., variable radiant power) light generated by two or more of the light sources combines to produce a mixed colored light (including essentially white light having a variety of color temperatures). In particular, the color (or color temperature) of the mixed colored light may be varied by varying one or more of the respective intensities (output radiant power) of the light sources (e.g., in response to one or more control signals output by the processor 102). Furthermore, the processor 102 may be particularly configured (e.g., programmed) to provide control signals to one or more of the light sources so as to generate a variety of static or time-varying (dynamic) multi-color (or multi-color temperature) lighting effects.

Thus, the lighting unit 100 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. As discussed above in connection with FIGS. 1-4, such combinations of differently colored LEDs in the lighting unit 100 can facilitate accurate reproduction of a host of desirable spectrums of lighting conditions, examples of which include, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments. Water, for example tends to absorb and attenuate most non-blue and non-green colors of light, so underwater applications may benefit from lighting conditions that are tailored to emphasize or attenuate some spectral elements relative to others.

As shown in FIG. 5, the lighting unit 100 also may include a memory 114 to store various information. For example, the memory 114 may be employed to store one or more lighting programs for execution by the processor 102 (e.g., to generate one or more control signals for the light sources), as well as various types of data useful for generating variable color radiation (e.g., calibration information, discussed further below). The memory 114 also may store one or more particular identifiers (e.g., a serial number, an address, etc.) that may be used either locally or on a system level to identify the lighting unit 100. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

One issue that may arise in connection with controlling multiple light sources in the lighting unit 100 of FIG. 5, and controlling multiple lighting units 100 in a lighting system (e.g., as discussed below in connection with FIG. 6), relates to potentially perceptible differences in light output between substantially similar light sources. For example, given two virtually identical light sources being driven by respective identical control signals, the actual intensity of light (e.g., radiant power in lumens) output by each light source may be measurably different. Such a difference in light output may be attributed to various factors including, for example, slight manufacturing differences between the light sources, normal wear and tear over time of the light sources that may differently alter the respective spectrums of the generated radiation, etc. For purposes of the present discussion, light sources for which a particular relationship between a control signal and resulting output radiant power are not known are referred to as "uncalibrated" light sources.

The use of one or more uncalibrated light sources in the lighting unit 100 shown in FIG. 5 may result in generation of light having an unpredictable, or "uncalibrated," color or color temperature. For example, consider a first lighting unit including a first uncalibrated red light source and a first uncalibrated blue light source, each controlled by a corresponding control signal having an adjustable parameter in a range of from zero to 255 (0-255), wherein the maximum value of 255 represents the maximum radiant power available from the light source. For purposes of this example, if the red control signal is set to zero and the blue control signal is non-zero, blue light is generated, whereas if the blue control signal is set to zero and the red control signal is non-zero, red light is generated. However, if both control signals are varied from non-zero values, a variety of perceptibly different colors may be produced (e.g., in this example, at very least, many different shades of purple are possible). In particular, perhaps a particular desired color (e.g., lavender) is given by a red control signal having a value of 125 and a blue control signal having a value of 200.

Now consider a second lighting unit including a second uncalibrated red light source substantially similar to the first uncalibrated red light source of the first lighting unit, and a second uncalibrated blue light source substantially similar to the first uncalibrated blue light source of the first lighting unit. As discussed above, even if both of the uncalibrated red light sources are driven by respective identical control signals, the actual intensity of light (e.g., radiant power in lumens) output by each red light source may be measurably different. Similarly, even if both of the uncalibrated blue light sources are driven by respective identical control signals, the actual light output by each blue light source may be measurably different.

With the foregoing in mind, it should be appreciated that if multiple uncalibrated light sources are used in combination in lighting units to produce a mixed colored light as discussed above, the observed color (or color temperature) of light produced by different lighting units under identical control conditions may be perceivably different. Specifically, consider again the "lavender" example above; the "first lavender" produced by the first lighting unit with a red control signal having a value of 125 and a blue control signal having a value of 200 indeed may be perceivably different than a "second lavender" produced by the second lighting unit with a red control signal having a value of 125 and a blue control signal having a value of 200. More generally, the first and second lighting units generate uncalibrated colors by virtue of their uncalibrated light sources.

In view of the foregoing, in one embodiment of the present disclosure, the lighting unit 100 includes calibration means to facilitate the generation of light having a calibrated (e.g., predictable, reproducible) color at any given time. In one aspect, the calibration means is configured to adjust (e.g., scale) the light output of at least some light sources of the lighting unit so as to compensate for perceptible differences between similar light sources used in different lighting units.

For example, in one embodiment, the processor 102 of the lighting unit 100 is configured to control one or more of the light sources 104A, 104B, and 104C so as to output radiation at a calibrated intensity that substantially corresponds in a predetermined manner to a control signal for the light source (s). As a result of mixing radiation having different spectra and respective calibrated intensities, a calibrated color is produced. In one aspect of this embodiment, at least one calibration value for each light source is stored in the memory 114, and the processor is programmed to apply the respective calibration values to the control signals for the corresponding light sources so as to generate the calibrated intensities.

In one aspect of this embodiment, one or more calibration values may be determined once (e.g., during a lighting unit manufacturing/testing phase) and stored in the memory 114 for use by the processor 102. In another aspect, the processor 102 may be configured to derive one or more calibration values dynamically (e.g. from time to time) with the aid of one or more photosensors, for example. In various embodiments, the photosensor(s) may be one or more external components coupled to the lighting unit, or alternatively may be integrated as part of the lighting unit itself. A photosensor is one example of a signal source that may be integrated or otherwise associated with the lighting unit 100, and monitored by the processor 102 in connection with the operation of the lighting unit. Other examples of such signal sources are discussed further below, in connection with the signal source 124 shown in FIG. 5.

One exemplary method that may be implemented by the processor 102 to derive one or more calibration values includes applying a reference control signal to a light source (e.g., corresponding to maximum output radiant power), and measuring (e.g., via one or more photosensors) an intensity of radiation (e.g., radiant power falling on the photosensor) thus generated by the light source. The processor may be programmed to then make a comparison of the measured intensity and at least one reference value (e.g., representing an intensity that nominally would be expected in response to the reference control signal). Based on such a comparison, the processor may determine one or more calibration values (e.g., scaling factors) for the light source. In particular, the processor may derive a calibration value such that, when applied to the reference control signal, the light source outputs radiation having an intensity that corresponds to the reference value (i.e., an "expected" intensity, e.g., expected radiant power in lumens).

In various aspects, one calibration value may be derived for an entire range of control signal/output intensities for a given light source. Alternatively, multiple calibration values may be derived for a given light source (i.e., a number of calibration value "samples" may be obtained) that are respectively applied over different control signal/output intensity ranges, to approximate a nonlinear calibration function in a piecewise linear manner.

In another aspect, as also shown in FIG. 5, the lighting unit 100 optionally may include one or more user interfaces 118 that are provided to facilitate any of a number of user-selectable settings or functions (e.g., generally controlling the light output of the lighting unit 100, changing and/or selecting various pre-programmed lighting effects to be generated by the lighting unit, changing and/or selecting various parameters of selected lighting effects, setting particular identifiers such as addresses or serial numbers for the lighting unit, etc.). In various embodiments, the communication between the user interface 118 and the lighting unit may be accomplished through wire or cable, or wireless transmission.

In one implementation, the processor 102 of the lighting unit monitors the user interface 118 and controls one or more of the light sources 104A, 104B, and 104C based at least in part on a user's operation of the interface. For example, the processor 102 may be configured to respond to operation of the user interface by originating one or more control signals for controlling one or more of the light sources. Alternatively, the processor 102 may be configured to respond by selecting one or more pre-programmed control signals stored in memory, modifying control signals generated by executing a lighting program, selecting and executing a new lighting program from memory, or otherwise affecting the radiation generated by one or more of the light sources.

In particular, in one implementation, the user interface 118 may constitute one or more switches (e.g., a standard wall switch) that interrupt power to the processor 102. In one aspect of this implementation, the processor 102 is configured to monitor the power as controlled by the user interface, and in turn control one or more of the light sources 104A, 104B, and 104C based at least in part on a duration of a power interruption caused by operation of the user interface. As discussed above, the processor may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

FIG. 5 also illustrates that the lighting unit 100 may be configured to receive one or more signals 122 from one or more other signal sources 124. In one implementation, the processor 102 of the lighting unit may use the signal(s) 122, either alone or in combination with other control signals (e.g., signals generated by executing a lighting program, one or more outputs from a user interface, etc.), so as to control one or more of the light sources 104A, 104B and 104C in a manner similar to that discussed above in connection with the user interface.

Examples of the signal(s) 122 that may be received and processed by the processor 102 include, but are not limited to, one or more audio signals, video signals, power signals, various types of data signals, signals representing information obtained from a network (e.g., the Internet), signals representing one or more detectable/sensed conditions, signals from lighting units, signals consisting of modulated light, etc. In various implementations, the signal source(s) 124 may be located remotely from the lighting unit 100, or included as a component of the lighting unit. For example, in one embodiment, a signal from one lighting unit 100 could be sent over a network to another lighting unit 100.

Some examples of a signal source 124 that may be employed in, or used in connection with, the lighting unit 100 of FIG. 5 include any of a variety of sensors or transducers that generate one or more signals 122 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., sensors that are sensitive to one or more particular spectra of electromagnetic radiation), various types of cameras, sound or vibration sensors or other pressure/force transducers (e.g., microphones, piezoelectric devices), and the like.

Additional examples of a signal source 124 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 122 based on measured values of the signals or characteristics. Yet other examples of a signal source 124 include various types of scanners, image recognition systems, voice or other sound recognition systems, artificial intelligence and robotics systems, and the like. A signal source 124 could also be a lighting unit 100, a processor 102, or any one of many available signal generating devices, such as media players, MP3 players, computers, DVD players, CD players, television signal sources, camera signal sources, microphones, speakers, telephones, cellular phones, instant messenger devices, SMS devices, wireless devices, personal organizer devices, and many others.

In one embodiment, the lighting unit 100 shown in FIG. 5 also may include one or more optical elements 130 to optically process the radiation generated by the light sources 104A, 104B, and 104C. For example, one or more optical elements may be configured so as to change one or both of a spatial distribution and a propagation direction of the generated radiation. In particular, one or more optical elements may be configured to change a diffusion angle of the generated radiation. In one aspect of this embodiment, one or more optical elements 130 may be particularly configured to variably change one or both of a spatial distribution and a propagation direction of the generated radiation (e.g., in response to some electrical and/or mechanical stimulus). Examples of optical elements that may be included in the lighting unit 100 include, but are not limited to, reflective materials, refractive materials, translucent materials, filters, lenses, mirrors, and fiber optics. The optical element 130 also may include a phosphorescent material, luminescent material, or other material capable of responding to or interacting with the generated radiation.

As also shown in FIG. 5, the lighting unit 100 may include one or more communication ports 120 to facilitate coupling of the lighting unit 100 to any of a variety of other devices. For example, one or more communication ports 120 may facilitate coupling multiple lighting units together as a networked lighting system, in which at least some of the lighting units are addressable (e.g., have particular identifiers or addresses) and are responsive to particular data transported across the network.

In particular, in a networked lighting system environment, as discussed in greater detail further below (e.g., in connection with FIG. 6), as data is communicated via the network, the processor 102 of each lighting unit coupled to the network may be configured to be responsive to particular data (e.g., lighting control commands) that pertain to it (e.g., in some cases, as dictated by the respective identifiers of the networked lighting units). Once a given processor identifies particular data intended for it, it may read the data and, for example, change the lighting conditions produced by its light sources according to the received data (e.g., by generating appropriate control signals to the light sources). In one aspect, the memory 114 of each lighting unit coupled to the network may be loaded, for example, with a table of lighting control signals that correspond with data the processor 102 receives. Once the processor 102 receives data from the network, the processor may consult the table to select the control signals that correspond to the received data, and control the light sources of the lighting unit accordingly.

In one aspect of this embodiment, the processor 102 of a given lighting unit, whether or not coupled to a network, may be configured to interpret lighting instructions/data that are received in a DMX protocol (as discussed, for example, in U.S. Pat. Nos. 6,016,038 and 6,211,626), which is a lighting command protocol conventionally employed in the lighting industry for some programmable lighting applications. For example, in one aspect, a lighting command in DMX protocol may specify each of a red channel control signal, a green channel control signal, and a blue channel control signal as an eight-bit digital signal representing a number from 0 to 255, wherein the maximum value of 255 for any one of the color channels instructs the processor 102 to control the corresponding light source(s) to generate the maximum available radiant power for that color. Hence, a command of the format [R, G, B]=[255, 255, 255] would cause the lighting unit to generate maximum radiant power for each of red, green and blue light (thereby creating white light). It should be appreciated, however, that lighting units suitable for purposes of the present disclosure are not limited to a DMX command format, as lighting units according to various embodiments may be configured to be responsive to other types of communication protocols so as to control their respective light sources.

In one embodiment, the lighting unit 100 of FIG. 5 may include and/or be coupled to one or more power sources 108. In various aspects, examples of power source(s) 108 include, but are not limited to, AC power sources, DC power sources, batteries, solar-based power sources, thermoelectric or mechanical-based power sources and the like. Additionally, in one aspect, the power source(s) 108 may include or be associated with one or more power conversion devices that convert power received by an external power source to a form suitable for operation of the lighting unit 100.

While not shown explicitly in FIG. 5, the lighting unit 100 may be implemented in any one of several different structural configurations according to various embodiments of the present disclosure. Examples of such configurations include, but are not limited to, an essentially linear or curvilinear configuration, a circular configuration, an oval configuration, a rectangular configuration, combinations of the foregoing, various other geometrically shaped configurations, various two or three dimensional configurations, and the like.

A given lighting unit also may have any one of a variety of mounting arrangements for the light source(s), enclosure/housing arrangements and shapes to partially or fully enclose the light sources, and/or electrical and mechanical connection configurations. In particular, a lighting unit may be configured as a replacement or "retrofit" to engage electrically and mechanically in a conventional socket or fixture arrangement (e.g., an Edison-type screw socket, a halogen fixture arrangement, a fluorescent fixture arrangement, etc.).

Additionally, one or more optical elements as discussed above may be partially or fully integrated with an enclosure/housing arrangement for the lighting unit. Furthermore, a given lighting unit optionally may be associated with (e.g., include, be coupled to and/or packaged together with) various other components (e.g., control circuitry such as the processor and/or memory, one or more sensors/transducers/signal sources, user interfaces, displays, power sources, power conversion devices, etc.) relating to the operation of the light source(s).

Figure 6:
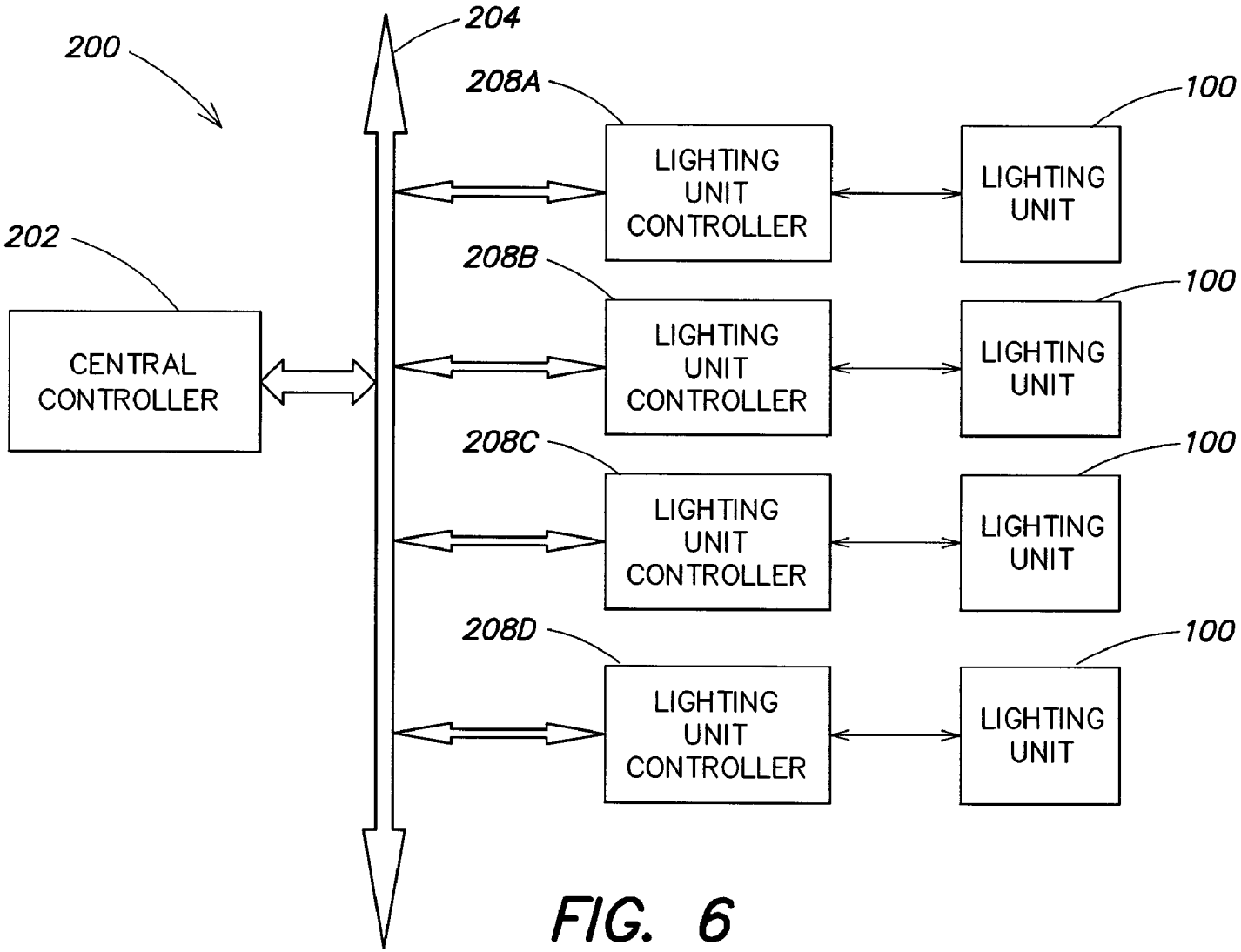
FIG. 6 is a diagram illustrating a networked lighting system according to one embodiment of the disclosure.

FIG. 6 illustrates an example of a networked lighting system 200 according to one embodiment of the present disclosure. In the embodiment of FIG. 6, a number of lighting units 100, similar to those discussed above in connection with FIG. 5, are coupled together to form the networked lighting system. It should be appreciated, however, that the particular configuration and arrangement of lighting units shown in FIG. 6 is for purposes of illustration only, and that the disclosure is not limited to the particular system topology shown in FIG. 6.

Additionally, while not shown explicitly in FIG. 6, it should be appreciated that the networked lighting system 200 may be configured flexibly to include one or more user interfaces, as well as one or more signal sources such as sensors/transducers. For example, one or more user interfaces and/or one or more signal sources such as sensors/transducers (as discussed above in connection with FIG. 5) may be associated with any one or more of the lighting units of the networked lighting system 200. Alternatively (or in addition to the foregoing), one or more user interfaces and/or one or more signal sources may be implemented as "stand alone" components in the networked lighting system 200. Whether stand alone components or particularly associated with one or more lighting units 100, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

As shown in the embodiment of FIG. 6, the lighting system 200 may include one or more lighting unit controllers (hereinafter "LUCs") 208A, 208B, 208C, and 208D, wherein each LUC is responsible for communicating with and generally controlling one or more lighting units 100 coupled to it. Although FIG. 6 illustrates one lighting unit 100 coupled to each LUC, it should be appreciated that the disclosure is not limited in this respect, as different numbers of lighting units 100 may be coupled to a given LUC in a variety of different configurations (serially connections, parallel connections, combinations of serial and parallel connections, etc.) using a variety of different communication media and protocols.

In the system of FIG. 6, each LUC in turn may be coupled to a central controller 202 that is configured to communicate with one or more LUCs. Although FIG. 6 shows four LUCs coupled to the central controller 202 via a generic connection 204 (which may include any number of a variety of conventional coupling, switching and/or networking devices), it should be appreciated that according to various embodiments, different numbers of LUCs may be coupled to the central controller 202. Additionally, according to various embodiments of the present disclosure, the LUCs and the central controller may be coupled together in a variety of configurations using a variety of different communication media and protocols to form the networked lighting system 200. Moreover, it should be appreciated that the interconnection of LUCs and the central controller, and the interconnection of lighting units to respective LUCs, may be accomplished in different manners (e.g., using different configurations, communication media, and protocols).

For example, according to one embodiment of the present disclosure, the central controller 202 shown in FIG. 6 may by configured to implement Ethernet-based communications with the LUCs, and in turn the LUCs may be configured to implement DMX-based communications with the lighting units 100. In particular, in one aspect of this embodiment, each LUC may be configured as an addressable Ethernet-based controller and accordingly may be identifiable to the central controller 202 via a particular unique address (or a unique group of addresses) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more lighting units coupled to it, for example, via a DMX protocol, based on the Ethernet communications with the central controller 202.

More specifically, according to one embodiment, the LUCs 208A, 208B, and 208C shown in FIG. 6 may be configured to be "intelligent" in that the central controller 202 may be configured to communicate higher level commands to the LUCs that need to be interpreted by the LUCs before lighting control information can be forwarded to the lighting units 100. For example, a lighting system operator may want to generate a color changing effect that varies colors from lighting unit to lighting unit in such a way as to generate the appearance of a propagating rainbow of colors ("rainbow chase"), given a particular placement of lighting units with respect to one another. In this example, the operator may provide a simple instruction to the central controller 202 to accomplish this, and in turn the central controller may communicate to one or more LUCs using an Ethernet-based protocol high level command to generate a "rainbow chase." The command may contain timing, intensity, hue, saturation or other relevant information, for example. When a given LUC receives such a command, it may then interpret the command and communicate further commands to one or more lighting units using a DMX protocol, in response to which the respective sources of the lighting units are controlled via any of a variety of signaling techniques (e.g., PWM).

It should again be appreciated that the foregoing example of using multiple different communication implementations (e.g., Ethernet/DMX) in a lighting system according to one embodiment of the present disclosure is for purposes of illustration only, and that the disclosure is not limited to this particular example.

From the foregoing, it may be appreciated that one or more lighting units as discussed above are capable of generating highly controllable variable color light over a wide range of colors, as well as variable color temperature white light over a wide range of color temperatures. For some applications involving dynamic changes in light output, it is desirable that transitions between different colors or color temperatures occur in a predictable, "smooth," or visually pleasing manner. Applicants have appreciated and recognized, however, that in some instances the human vision phenomenon of perceiving saturated colors more brightly than unsaturated colors, pursuant to the "Helmholtz-Kohlrausch" (HK) effect, may adversely impact the perception of a desired lighting effect (e.g., a transition from one lighting state to another).

Figure 7:
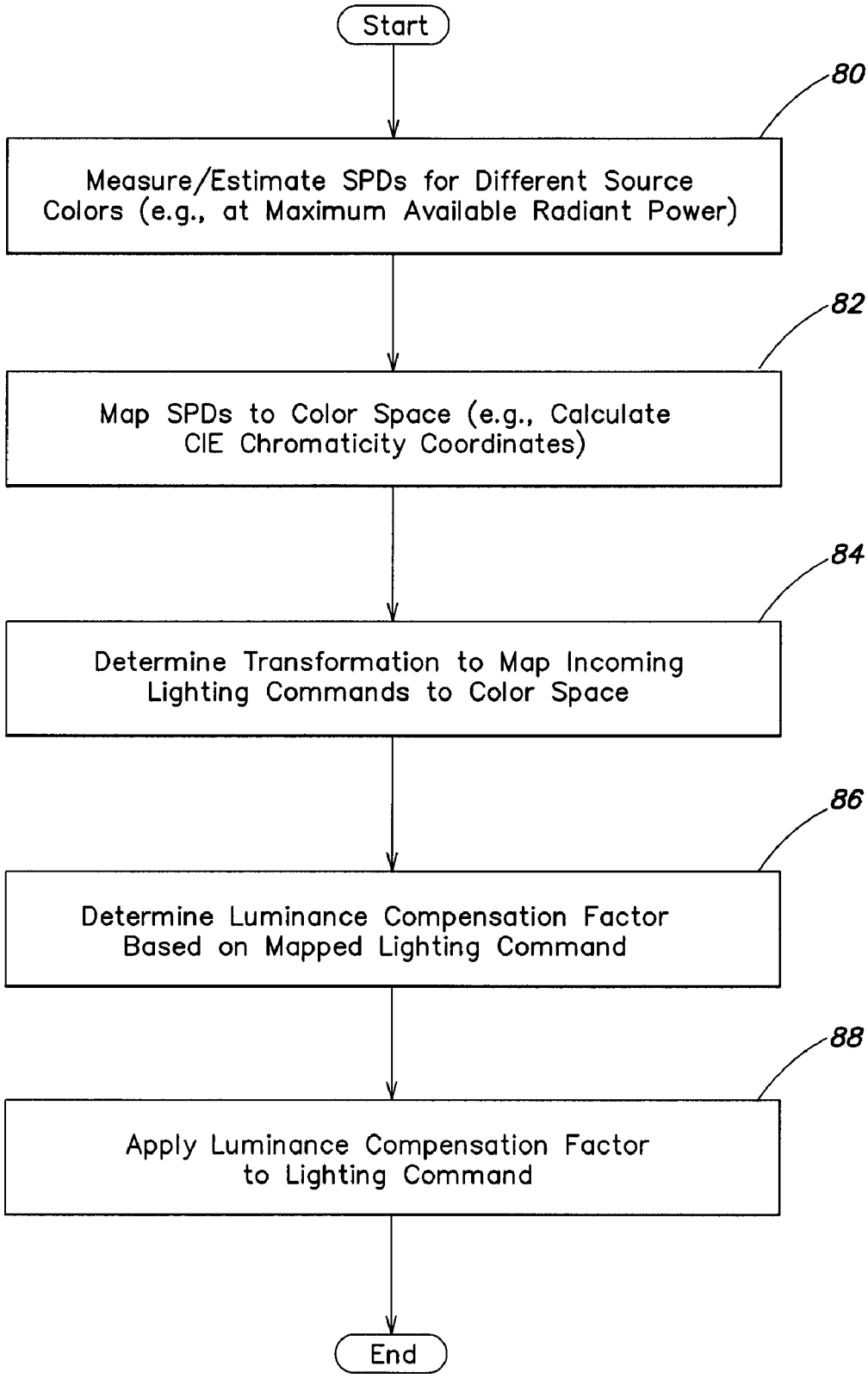
FIG. 7 is a flow chart illustrating a method according to one embodiment of the disclosure for providing luminance compensation, for example, in one or more lighting units similar to those shown in FIGS. 5 and 6.

In view of the foregoing, one embodiment of the present disclosure is directed to methods and apparatus for providing luminance compensation so as to mitigate the HK effect. FIG. 7 is a flow chart illustrating a method according to one embodiment of the disclosure for providing such luminance compensation. In one exemplary implementation, the processor 102 of one or more lighting units similar to those shown in FIGS. 5 and 6 may be appropriately configured (e.g., programmed) to implement the method outlined in FIG. 7.

According to one aspect of the embodiment illustrated in FIG. 7, to facilitate a determination of appropriate luminance compensation for a given color or color temperature generated by the lighting unit, first a spectral power distribution (SPD) may be measured or estimated for each of the different source colors of a given lighting unit 100. For purposes of the discussion immediately below, an exemplary lighting unit 100 is considered having one or more red LEDs, one or more green LEDs, and one or more blue LEDs. With the foregoing in mind, as indicated in block 80 of FIG. 7, an SPD may be measured (by an appropriate measuring instrument) for a red LED (or a group of red LEDs energized together), a green LED (or a group of green LEDs energized together), and a blue LED (or a group of blue LEDs energized together); alternatively, an SPD may be assumed for a given color LED source or group of sources energized together, based on an expected/approximate dominant wavelength, FWHM, and radiant power. In one aspect of this embodiment, the SPDs are measured (or estimated) at maximum available radiant powers for the respective source colors.

For some applications, whether the SPDs are measured or estimated, it may be desirable to take into account one or more intervening surfaces between the generated light and an anticipated point of perception of the light. For example, consider an application in which a given lighting unit is positioned so as to illuminate one or more walls of a room, and the light generated by the lighting unit generally is perceived in the room after the light has reflected off of the wall(s). Based on the physical properties of the material constituting the wall(s), including possible wall coverings such as paints, wallpapers, etc., the light reflected from the wall(s) and ultimately perceived may have an appreciably different SPD than the light impinging on the wall(s). More specifically, the wall(s) (or any other intervening surface) may absorb/reflect each of the source spectrums (e.g., the red, green and blue light) somewhat differently. In view of the foregoing, in one embodiment some or all of the SPDs may be measured, estimated, or specifically modeled to include the effects of one or more intervening surfaces that may be present in a given application, so as to take into account light-surface interactions in the determination of luminance compensation.

As indicated in block 82 of FIG. 7, the measured or estimated SPDs subsequently may be mapped to some color model or color space serving as a frame of reference for categorizing color. As discussed above in connection with FIG. 1, the CIE color system provides one conventional example of a useful reference frame for categorizing color, via the CIE chromaticity diagram for example. While the discussion below focuses on the CIE color system (and, in particular, the CIE chromaticity diagram) as a frame of reference, again it should be appreciated that the concepts disclosed herein generally are applicable to any of a variety of constructs used to describe a color model, space, or system that may be employed to facilitate a determination of luminance compensation.

In view of the foregoing, in one exemplary implementation of the embodiment outlined in FIG. 7, CIE chromaticity coordinates x,y may be calculated in the manner described above in connection with FIG. 1 and plotted on the CIE chromaticity diagram for each different color source (or group of sources) of the lighting unit 100. Depending on several factors including, but not limited to, dominant wavelength, spectral changes due to LED drive current and/or temperature, manufacturing differences and the like, approximate but illustrative values for typical chromaticity-coordinates for the different LED colors are indicated in Table 1 below. As indicated earlier, exemplary approximate dominant wavelengths for commonly available red, green and blue LEDs include 615-635 nanometers for red LEDs, 515-535 nanometers for green LEDs, and 460-475 nanometers for blue LEDs.

TABLE 1

| LED Color | x-coordinate | y-coordinate |
|---|---|---|
| Red | 0.7 | 0.3 |
| Green | 0.17 | 0.68 |
| Blue | 0.115 | 0.14 |

Figure 8:
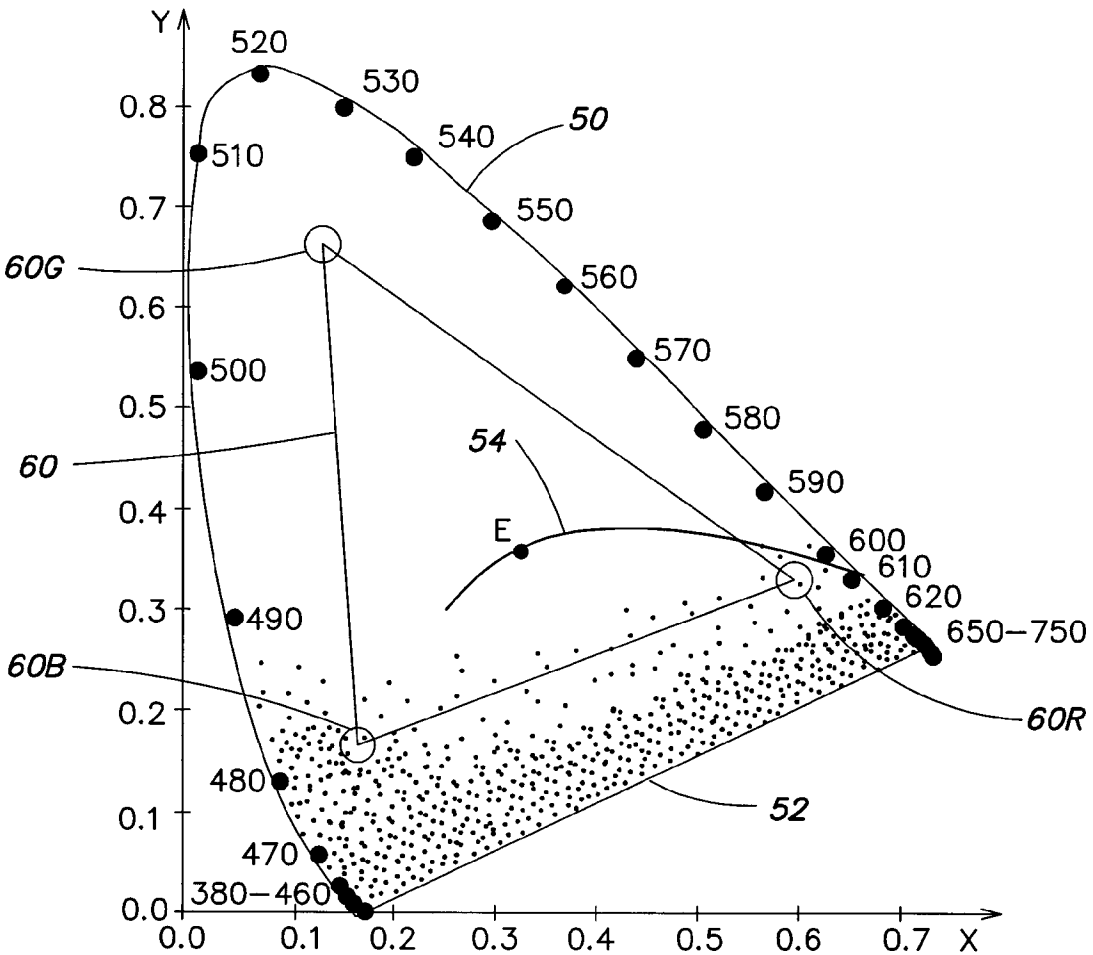
FIG. 8 illustrates the diagram of FIG. 1, onto which is mapped a color gamut based on red, green and blue LED-based light sources of the lighting unit of FIG. 5, according to one embodiment of the disclosure.

FIG. 8 illustrates the CIE chromaticity diagram of FIG. 1, onto which are mapped the x,y chromaticity coordinates from Table 1 generally representative of red, green and blue LED sources that may be employed in the lighting unit 100. The resulting three points 60R, 60G and 60B form an enclosed area referred to as a color gamut 60, representing the colors that may be generated by the lighting unit 100 using the red, green and blue sources based on additive mixing. In FIG. 8, the white light/black body curve 54 and the achromatic point E also are illustrated; as can be seen, a significant portion of the curve 54 falls within the gamut 60.

Once the SPDs are mapped to the color space serving as a reference frame (e.g., the CIE chromaticity diagram), a transformation may be determined to subsequently map to the color space lighting commands representing arbitrary combinations of the red, green and blue source colors of the lighting unit 100, as indicated in block 84 of FIG. 7. In an implementation employing the CIE color system, this process relates significantly to the CIE tristimulus values determined for each of the different source colors of the lighting unit 100.

In particular, in calculating the x,y chromaticity coordinates for the respective primary color LED sources, as discussed above in connection with FIG. 1 each source is associated (via the color matching functions $\bar{x}(\lambda)$, $\bar{y}(\lambda)$, $\bar{z}(\lambda)$) with a corresponding set of CIE tristimulus values X, Y, and Z. According to one aspect of the embodiment of FIG. 7, a matrix transformation may be derived, based on the three sets of tristimulus values, to map an arbitrary R-G-B ratio representing a desired color or color temperature to a corresponding set of tristimulus values according to:

$$\begin{bmatrix} X_R & X_G & X_B \\ Y_R & Y_G & Y_B \\ Z_R & Z_G & Z_B \end{bmatrix} \begin{bmatrix} R \\ G \\ B \end{bmatrix} = \begin{bmatrix} X \\ Y \\ Z \end{bmatrix}. \tag{5}$$

In Eq. (5), the R-G-B column vector represents relative amounts of the respective sources according to some predetermined scale (zero to some maximum value representing maximum available output radiant power for each source). For example, in one embodiment, a lighting command may specify each of the R, G, and B values in the column vector as a number varying from 0 to 255, wherein lighting commands are processed by the lighting unit according to the DMX protocol (in which eight bits are employed to specify the relative strength of each different color source). It should be appreciated, however, that virtually any scale may be employed, in any of a variety of lighting command formats, to specify the relative amounts of the respective sources.

In Eq. (5), each column of the three-by-three transformation matrix represents the tristimulus values for one of the primary colors at its maximum possible value in the R-G-B column vector (e.g., $X_R$, $Y_R$, and $Z_R$ represent the tristimulus values for the red primary source at maximum available output radiant power, wherein $Y_R$ represents the maximum luminance from the red source). Finally, the column vector X-Y-Z in Eq. (5) represents the resulting CIE tristimulus values of the desired color corresponding to the arbitrary ratio specified in the R-G-B column vector, wherein Y represents the luminance of the desired color. Hence, according to the transformation given in Eq. (5) above, any arbitrary combination of light generated by the red, green and blue LED sources (i.e., relative proportions of red, green and blue, indicated by the R-G-B column vector in Eq. (5)) may be mapped to the CIE tristimulus values, which in turn are normalized and mapped to the chromaticity diagram, falling within or along the perimeter of the gamut 60 shown in FIG. 8.

Once a lighting command can be mapped to the CIE chromaticity diagram, a corresponding luminance compensation factor may be determined for the lighting command, as indicated in block 86 of FIG. 7. In an exemplary implementation according to one embodiment, a luminance compensation factor may be derived based on Eq. (2) above; for example, the value F may be calculated based on Eq. (2) utilizing the chromaticity coordinates x,y corresponding to the mapped lighting command. In turn, the value $10^F$ can be calculated, thereby associating a relative measure of perceived brightness with the lighting command based on the isobrightness contours illustrated in FIG. 4.

Figure 4:
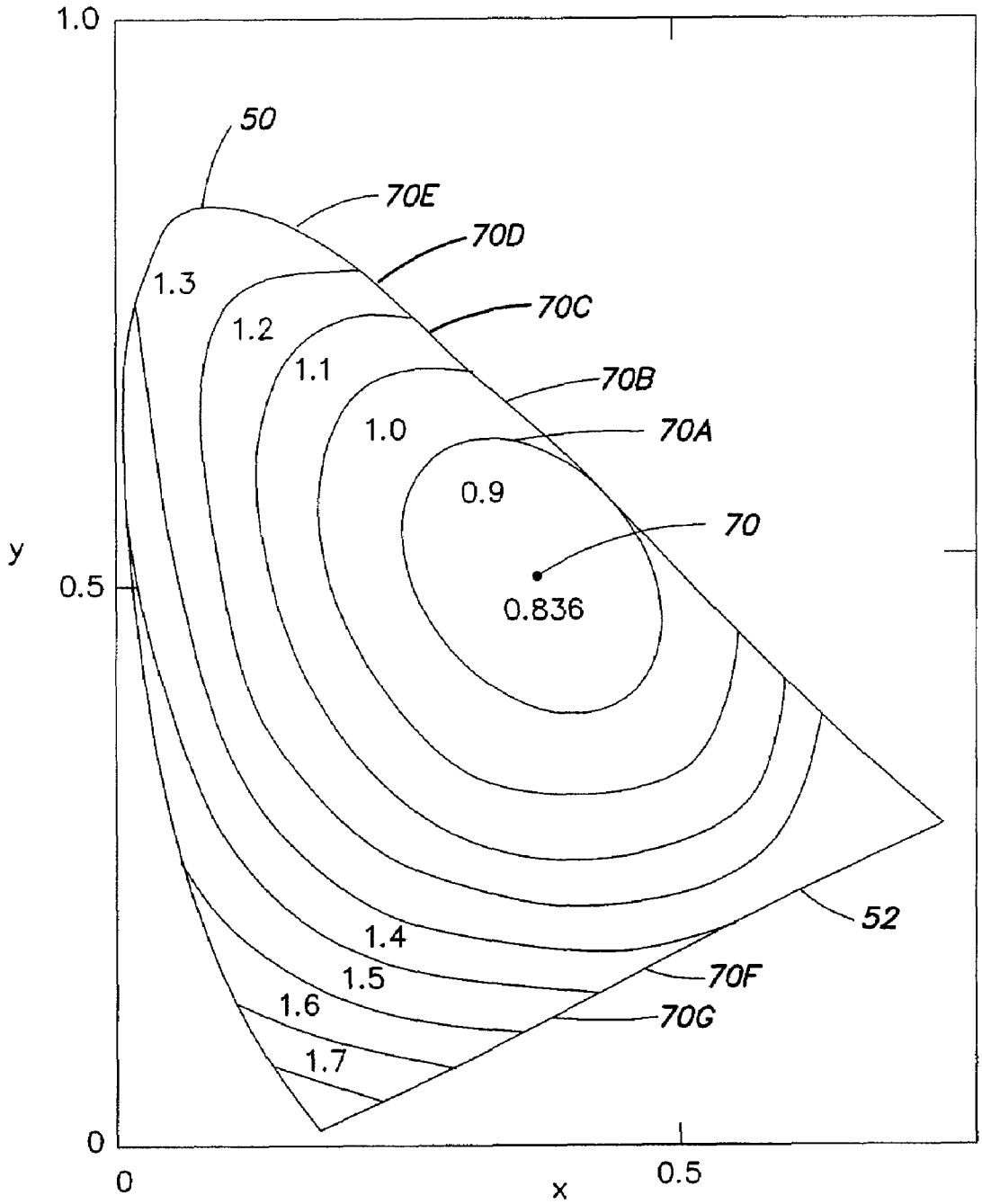
FIG. 4 PRIOR ART
FIG. 4 illustrates the diagram of FIG. 1, onto which are mapped contours of constant perceived brightness pursuant to the "Helmholtz-Kohlrausch" effect.

In one aspect, a scaling factor may be applied to the value $10^F$ to arrive at a luminance compensation factor, such that the nadir 70 of the isobrightness contours shown in FIG. 4 corresponds to the maximum luminance generated by the lighting unit 100. In this aspect, lighting commands mapped onto isobrightness contours beyond the nadir 70 are attenuated by the luminance compensation factor.

For example, consider a luminance compensation factor (LCF) defined as:

$$LCF = \frac{0.836}{10^F}. \tag{6}$$

Based on Eq. (6) above, a lighting command mapped onto the nadir 70 in FIG. 4 would have a luminance compensation factor LCF=1. Lighting commands mapped to any other portion of the chromaticity diagram would have a luminance compensation factor less than one (e.g., between approximately 0.45 near saturated blue to approximately 0.93 around the nadir 70).

As indicated in block 88 of FIG. 7, the luminance compensation factor once determined can be applied to the lighting command so as to mitigate, at least in part, the "Helmholtz-Kohlrausch" (HK) effect. For example, a luminance compensation factor according to Eq. (6) above may be applied as an identical multiplier to each element of the original R-G-B lighting command (e.g., the R-G-B column vector of Eq. (5)), after which the processor 102 processes the modified command to provide luminance compensation for the resulting color generated by the lighting unit. Since luminance is additive, and each source color of the lighting command is scaled identically by the luminance compensation factor, the resulting luminance of the additive mix of colors is appropriately compensated.

As may be appreciated from Eq. (6) above, the application of a luminance compensation factor to a lighting command may significantly reduce the overall possible dynamic range of brightness for some colors as compared to others; in essence, some dynamic range is sacrificed for more saturated colors. In view of the foregoing, according to one embodiment the relationship of Eq. (6) may be modified, or another relationship defined, such that only "partial" compensation for the HK effect is provided.

For example, in one aspect, luminance compensation may be limited in terms of the range of colors or color temperatures to which compensation is applied (e.g., applying luminance compensation to only some predetermined portion of the color space, defining some minimum LCF to limit the attenuation of more saturated colors, etc.). In another aspect, luminance compensation may be scaled, limited, or applied in a piece-wise linear or nonlinear fashion over some range of colors or color temperatures. In yet another aspect, luminance compensation may be limited by specifying predetermined limited amounts of compensation over a predetermined limited range of colors or color temperatures. In general, pursuant to the foregoing examples, according to one embodiment the application of luminance compensation to lighting commands may take into consideration some balance between the luminance compensation and the notion of sacrificing a dynamic range of brightness for more saturated colors.

While the foregoing discussion presented a derivation of a luminance compensation factor based on the empirical formula for F given in Eq. (2) and the resulting contours on the CIE chromaticity diagram shown in FIG. 4, it should be appreciated that the teachings of the present disclosure are not limited in this respect. More generally, any of a variety of models for the HK effect (e.g., other empirical determinations or mathematical models) may be employed to generate a luminance compensation factor based on mapping a lighting command to CIE chromaticity coordinates.

For example, as an alternative to the specific nonlinear relationship provided by Eq. (2), a look-up table may be stored (e.g., in the memory 114 of a lighting unit 100), in which is specified a predetermined luminance compensation factor corresponding to a given pair of chromaticity coordinates. The mapping of a luminance compensation factor to a pair of chromaticity coordinates in such a look-up table may be based in part on the empirical formula given by Eq. (2), or by some other relationship (e.g., formula or algorithm) modeling the HK effect. Additionally, the resolution between different luminance compensation factors to be applied to lighting commands may be determined in any of a number of ways. For example, in one embodiment, a look-up table may store luminance compensation values corresponding to a relatively smaller number of isobrightness contours than indicated in FIG. 4, and interpolation may be employed to determine luminance compensation values intermediate to those actually stored in the look-up table. Such interpolation may include, for example, piece-wise, linear or non-linear (Nth order) interpolation. The concept of interpolation may be extended to any of a variety of luminance compensation models; in one aspect, the use of interpolation may facilitate a less memory-intensive implementation of luminance compensation.

By providing luminance compensation values according to the various concepts discussed above, one or more lighting units 100 may be controlled to provide a wide variety of different colors or color temperatures of light while maintaining a constant level of perceived brightness. For example, a lighting unit 100 may be configured to generate a "rainbow" of light by cycling through a wide variety of saturated and unsaturated colors at some predetermined rate and prescribed same luminance for all of the colors, and maintain a constant level of perceived brightness for all of the colors according to the luminance compensation methods discussed herein. Similarly, a lighting unit may be configured to provide white light over a wide range of the white light/black body curve 54 shown in FIG. 3, wherein different color temperatures of white light (spanning different isobrightness contours of FIG. 4) having a same prescribed luminance are perceived with the same brightness according to the luminance compensation methods discussed herein.

It should be appreciated that the concepts discussed above in connection with FIGS. 7 and 8 may be implemented for each of multiple lighting units 100 of a lighting network similar to that shown in FIG. 6, to provide luminance compensation on a network/system level.

Moreover, while the foregoing discussion in connection with FIG. 8 used the example of a color gamut 60 based on red, green and blue LED sources in the lighting unit 100, it should be appreciated that, theoretically, any arbitrary gamut may be envisioned within (or including a portion of the perimeter of the CIE chromaticity diagram spectral locus 50 and purple boundary 52. For example, any two or more different chromaticity points within the enclosed area or on the perimeter of the CIE diagram (e.g., any two or more differently colored LED sources, including two white LEDs having different spectrums) may define a gamut. Furthermore, any three or more different chromaticity points may form a triangle or other polygon defining a gamut, wherein at least some or all of the different chromaticity points serve as respective vertices of the polygon. More generally, gamuts having arbitrarily curved shapes, and/or various numbers of flat sides, may be mathematically defined. Practically speaking, the points serving as the vertices of a polygonal gamut may correspond or relate in some way to an existing source of light (e.g., one or more LEDs) that is employed to generate the various colors or color temperatures of the gamut based on additive mixing principles.

In any case, it should be appreciated that the concepts discussed herein may be applied to other multiple-color and white light-generating constructs (e.g., lighting units similar to those discussed above in connection with FIGS. 5 and 6, employing various numbers of different primary sources that may or may not include one or more of the red, green and blue LED sources discussed above), and any of a variety of defined gamuts (based on actual sources or mathematical derivation). Stated differently, in a colored or white light generation system based on additive mixing of arbitrary different sources, a transformation may be derived (e.g., in a manner similar to that discussed above in connection with Eq. (5) above) such that any representation of a visible stimulus that may be generated can be mapped to the CIE chromaticity diagram shown in FIG. 1, and a luminance compensation factor appropriately determined and applied pursuant to the methodology outlined in FIG. 7.

More generally, according to other embodiments of the present disclosure, color models, color systems or color spaces other than the CIE color system and CIE x,y chromaticity diagram may be employed as reference frames, in relation to which some model for the HK effect is defined. In one aspect of these embodiments, any arbitrary lighting command can be mapped onto a given reference frame (again, in a manner similar to that discussed above in connection with Eq. (5) above) and, based on an associated model for the HK effect, luminance compensation factors may be derived according to the various concepts discussed herein.

Having thus described several illustrative embodiments, it is to be appreciated that various alterations, modifications, and improvements will readily occur to those skilled in the art. Such alterations, modifications, and improvements are intended to be part of this disclosure, and are intended to be within the spirit and scope of this disclosure. While some examples presented herein involve specific combinations of functions or structural elements, it should be understood that those functions and elements may be combined in other ways according to the present invention to accomplish the same or different objectives. In particular, acts, elements, and features discussed in connection with one embodiment are not intended to be excluded from similar or other roles in other embodiments. Accordingly, the foregoing description and attached drawings are by way of example only, and are not intended to be limiting.

The invention claimed is:

1. A method of controlling at least one LED-based lighting unit for generating multi-colored light or variable color temperature white light, the method comprising an act of A) generating from the at least one LED-based lighting unit two different colors or color temperatures of the multi-colored light or variable color temperature white light, over a significant range of different saturations or different color temperatures, with an essentially constant perceived brightness, wherein the act A) comprises acts of:

B) generating first light having a first color or a first color temperature based at least in part on a first lighting command, the first lighting command representing at least a prescribed first luminance for the first light;

C) generating second light, having a second color different from the first color or a second color temperature different from the first color temperature, based at least in part on a second lighting command, the second lighting command representing at least a prescribed second luminance for the second light, wherein the prescribed second luminance is the same as the prescribed first luminance; and D) modifying at least one of the first lighting command and the second lighting command such that a perceived first brightness of the first light is essentially identical to a perceived second brightness of the second light.

2. The method of claim 1, wherein the act D) comprises an act of:

applying a luminance compensation factor to the at least one of the first lighting command and the second lighting command based at least in part on at least one model for the Helmholtz-Kohlrausch effect.

3. An apparatus, comprising:

at least one LED configured to generate at least two different colors or color temperatures of light over a significant range of different saturations or different color temperatures; and at least one controller to control the at least one LED so as to generate the at least two different colors or color temperatures of the light such that they are perceived with an essentially constant brightness wherein the at least one controller is configured to:

control the at least one LED so as to generate first light having a first color or a first color temperature based at least in part on a first lighting command, the first lighting command representing at least a prescribed first luminance for the first light;

control the at least one LED so as to generate second light, having a second color different from the first color or a second color temperature different from the first color temperature, based at least in part on a second lighting command, the second lighting command representing at least a prescribed second luminance for the second light, wherein the prescribed second luminance is the same as the prescribed first luminance; and modify at least one of the first lighting command and the second lighting command such that a perceived first brightness of the first light is essentially identical to a perceived second brightness of the second light.

4. The apparatus of claim 3, wherein the at least one controller is configured to apply a luminance compensation factor to the at least one of the first lighting command and the second lighting command based at least in part on at least one model for the Helmholtz-Kohlrausch effect.

5. A method, comprising acts of:

A) mapping a lighting command to a reference frame in relation to which at least one model for the Helmholtz-Kohlrausch effect is defined, the lighting command specifying at least a color or a color temperature of light to be generated; and B) applying a luminance compensation factor to the lighting command, based on the at least one model for the Helmholtz-Kohlrausch effect and the mapped lighting command, to provide an adjusted lighting command;

wherein the act A) comprises an act of:

modeling the Helmholtz-Kohlrausch effect via a look-up table that includes a plurality of luminance compensation factors corresponding to different mapped lighting commands; and selecting the luminance compensation factor as one of the plurality of luminance compensation factors based on the mapped lighting command.

6. A method, comprising acts of:

A) mapping a lighting command to a reference frame in relation to which at least one model for the Helmholtz-Kohlrausch effect is defined, the lighting command specifying at least a color or a color temperature of light to be generated; and B) applying a luminance compensation factor to the lighting command, based on the at least one model for the Helmholtz-Kohlrausch effect and the mapped lighting command, to provide an adjusted lighting command;

wherein the model for the Helmholtz-Kohlrausch effect includes a plurality of isobrightness contours defined in relation to the reference frame, and wherein the act B) comprises an act of:

B1) applying the luminance compensation factor to the lighting command, based on one isobrightness contour of the plurality of isobrightness contours into which the lighting command is mapped, to provide the adjusted lighting command.

7. The method of claim 6, further comprising an act of:

C) applying the adjusted lighting command to at least one LED-based light source to generate luminance-compensated light having the specified color or color temperature.

8. The method of claim 6, wherein the reference frame includes a CIE chromaticity diagram, wherein the plurality of isobrightness contours are defined in relation to the CIE chromaticity diagram, and wherein the act A) comprises an act of:

mapping the lighting command to the CIE chromaticity diagram.

9. The method of claim 8, wherein the plurality of isobrightness contours are defined by a nonlinear function of CIE chromaticity coordinates.

10. An apparatus, comprising:

at least one LED; and at least one controller to control the at least one LED based at least in part on a lighting command that specifies at least first color or a first color temperature of light to be generated by the at least one LED, the at least one controller configured to map the lighting command to a reference frame in relation to which at least one model for the Helmholtz-Kohlrausch effect is defined, the at least one controller further configured to:

i) apply a luminance compensation factor to the lighting command, based on the at least one model for the Helmholtz-Kohlrausch effect and the mapped lighting command, to provide an adjusted lighting command; and (ii) to control the at least one LED based on the adjusted lighting command so as to generate luminance-compensated light having the first color or the first color temperature, wherein the at least one controller includes at least one memory, and wherein the at least one controller is configured to model the Helmholtz-Kohlrausch effect via a look-up table stored in the memory, the look-up table including a plurality of luminance compensation factors corresponding to different mapped lighting commands, and wherein the at least controller further is configured to select the luminance compensation factor as one of the plurality of luminance compensation factors in the look-up table, based on the mapped lighting command.

11. An apparatus, comprising:

at least one LED; and at least one controller to control the at least one LED based at least in part on a lighting command that specifies at least first color or a first color temperature of light to be generated by the at least one LED, the at least one controller configured to map the lighting command to a reference frame in relation to which at least one model for the Helmholtz-Kohlrausch effect is defined, the at least one controller further configured to:

(i) apply a luminance compensation factor to the lighting command, based on the at least one model for the Helmholtz-Kohlrausch effect and the mapped lighting command, to provide an adjusted lighting command; and (ii) to control the at least one LED based on the adjusted lighting command so as to generate luminance-compensated light having the first color or the first color temperature, wherein the at least one controller is configured to:

model the Helmholtz-Kohlrausch effect as a plurality of isobrightness contours defined in relation to the reference frame, and apply the luminance compensation factor to the lighting command, based on one isobrightness contour of the plurality of isobrightness contours into which the lighting command is mapped, to provide the adjusted lighting command.

12. The apparatus of claim 11, wherein the reference frame includes a CIE chromaticity diagram, wherein the at least one controller is configured to define the plurality of isobrightness contours in relation to the CIE chromaticity diagram, and wherein the at least one controller further is configured to map the lighting command to the CIE chromaticity diagram.

13. The apparatus of claim 12, wherein the at least one controller is configured to define the plurality of isobrightness contours as a nonlinear function of CIE chromaticity coordinates.

* * * * *